US010029880B2

(12) United States Patent
Ishihara et al.

(10) Patent No.: US 10,029,880 B2
(45) Date of Patent: Jul. 24, 2018

(54) SHEET BUNDLE BINDING DEVICE AND IMAGE FORMING SYSTEM HAVING THE SAME

(71) Applicants: Mitsuhiro Ishihara, Yamanashi-ken (JP); Takashi Saito, Yamanashi-ken (JP); Isao Kondo, Yamanashi-ken (JP)

(72) Inventors: Mitsuhiro Ishihara, Yamanashi-ken (JP); Takashi Saito, Yamanashi-ken (JP); Isao Kondo, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 71 days.

(21) Appl. No.: 15/288,305

(22) Filed: Oct. 7, 2016

(65) Prior Publication Data

US 2017/0101285 A1 Apr. 13, 2017

(30) Foreign Application Priority Data

Oct. 8, 2015 (JP) ..... 2015-200462

(51) Int. Cl.

*B65H 43/00* (2006.01)
*B65H 37/04* (2006.01)
*B65H 31/30* (2006.01)

(52) U.S. Cl.

CPC ..... *B65H 43/00* (2013.01); *B65H 31/3081* (2013.01); *B65H 37/04* (2013.01); *B65H 2301/51611* (2013.01); *B65H 2301/51616* (2013.01); *B65H 2801/27* (2013.01)

(58) Field of Classification Search

CPC ..... G03G 15/6544; G03G 15/6541; B42C 11/02; B42C 11/04

See application file for complete search history.

(56) References Cited

U.S. PATENT DOCUMENTS

2015/0117983 A1* 4/2015 Kubota ..... B42B 4/00 412/35
2016/0159605 A1* 6/2016 Miyahara ..... G03G 15/6544 270/1.01
2016/0194173 A1* 7/2016 Okada ..... B65H 37/04 270/58.09

FOREIGN PATENT DOCUMENTS

JP H09-315669 A 12/1997
JP 2012-121711 A 6/2012
JP 2014-172693 A 9/2014
JP 2015-013725 A 1/2015
JP 2015-016970 A 1/2015

* cited by examiner

*Primary Examiner* — Blake A Tankersley
*Assistant Examiner* — Quang X Nguyen
(74) *Attorney, Agent, or Firm* — Manabu Kanesaka

(57) ABSTRACT

The present invention is to provide a sheet bundle binding device having both a staple binding unit and a staple-free binding unit, capable of performing binding in two stages of proper binding and temporary binding so as to obtain a desired binding force and to easily remove some sheets from a bound sheet bundle. A binding control section determines, based on user's settings, whether or not to perform first binding in which a first sheet bundle Sb1 is subjected to the proper binding using the staple binding unit or staple-free binding unit and determines whether or not to perform second binding in which a second sheet bundle obtained by accumulating additional sheets on the first sheet bundle is subjected to the temporary binding using the staple-free binding unit so as to control binding forces with which the first and second sheet bundles are bound.

13 Claims, 16 Drawing Sheets

FIG. 6A
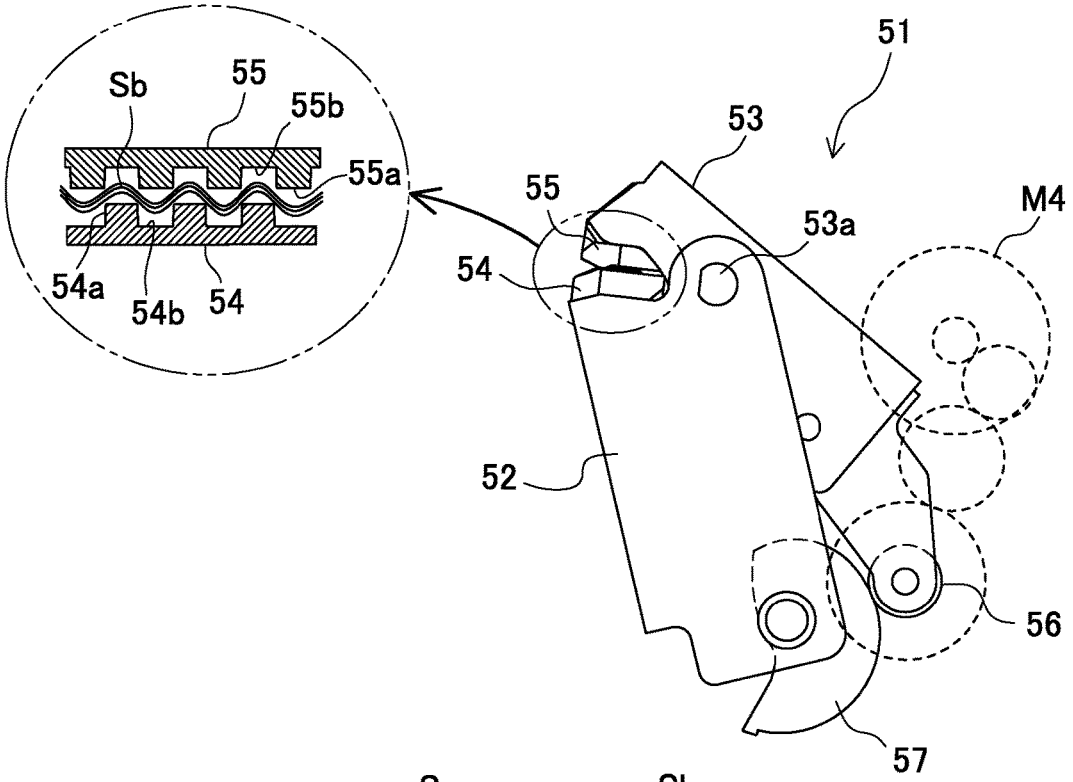
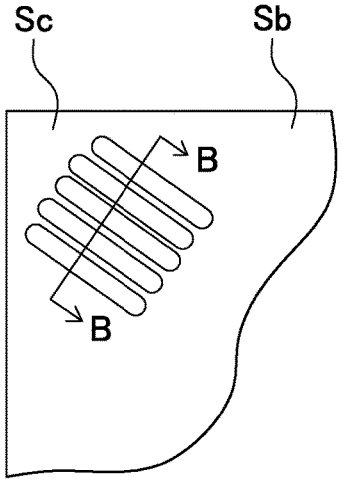
FIG. 6B
FIG. 6C
Enlarged cross section taken along line B-B
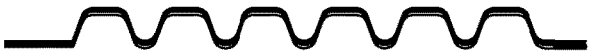

SHEET BUNDLE BINDING DEVICE AND IMAGE FORMING SYSTEM HAVING THE SAME

RELATED APPLICATIONS

The present application is based on, and claims priority from, Japanese Application No. JP2015-200462 filed Oct. 8, 2015 the disclosure of which is hereby incorporated by reference herein in its entirety.

BACKGROUND OF THE INVENTION

Field of the Invention

The present invention relates to a sheet bundle binding device that bundles a plurality of sheets fed from, e.g., an image forming device and automatically performs staple-free binding for the sheet bundle and an image forming system having the sheet bundle binding device.

Description of the Related Art

Recently, in addition to a stapling device that drives a metal needle into a plurality of stacked sheets to bind the sheets, there is used a staple-free binding device that sandwiches a plurality of stacked sheets between a pair of concavo-convex crimping teeth and strongly presses the sheets for pressure bonding to bind the sheets. Both the stapling device and the staple-free binding device have a problem in that when some sheets need to be removed from the bound sheet bundle, the removing operation is very troublesome, and all the sheets of the sheet bundle tend to be separated from each other.

To solve the above problem, there is proposed an image forming device provided with a stapler that drives a staple needle in a sheet bundle stored in a discharge tray and a sewing unit that forms perforation on the sheet bundle at a position surrounding a stable needle driving position. With this configuration, a desired sheet can be cut off along the perforation to be removed from the sheet bundle (see, for example, Patent Document 1). Further, there is known a sheet post-processing that unifies some small group sheet bundles bound by a staple needle driven inside a perforation into a large group sheet bundle and then binds the large group sheet bundle with a staple needle at an outside portion of the perforation. With this configuration, the small group sheet bundle can be cut off along the perforation and removed from the large group sheet bundle (see, for example, Patent Document 2).

In the staple-free binding, when the number of sheets to be bound is increased, a binding force between sheets constituting a sheet bundle is reduced, so that the number of sheets that can be bound in single binding processing is limited. In order to cope with this, there is known a sheet processing device that has a plurality of binding sections that perform staple-free binding for a sheet bundle at different binding positions, wherein a part of a sheet bundle bound at one binding position is bound together with another sheet bundle bound at another binding position so as to increase the number of sheets to be bound (see, for example, Patent Document 3).

Further, there is proposed a sheet bundle binding device provided with both a stapler unit that binds a sheet bundle by driving a staple needle into the sheet bundle and a staple-free binding unit that press-binds a sheet bundle without using a staple needle (see, for example, Patent Document 4 and Patent Document 5). A user can select the staple binding or staple-free binding according to the usage of the sheet bundle.

PRIOR ART DOCUMENT

Patent Document

[Patent Document 1] Japanese Patent Application Publication No. 09-315669

[Patent Document 2] Japanese Patent Application Publication No. 2012-121711

[Patent Document 3] Japanese Patent Application Publication No. 2014-172693

[Patent Document 4] Japanese Patent Application Publication No. 2015-016970

[Patent Document 5] Japanese Patent Application Publication No. 2015-013725

In the staple binding, by using an appropriate staple needle for the thickness of a sheet bundle (and, in some cases, hardness of each sheet), a desired binding force can be ensured for the sheet bundle. On the other hand, in the staple-free binding, the number of sheets and the thickness of a sheet bundle that can be bound with a desired binding force are limited.

However, the devices described in Patent Document 4 and Patent Document 5 simply perform staple binding or staple-free binding according to a user request. Therefore, a prescribed number or more of sheets may be staple-free bound and, in this case, the binding force is small, so that the sheets of the sheet bundle are easily removed from the sheet bundle and separated from each other. Further, these documents neither disclose nor suggest a binding method capable of achieving easy removal of some sheets from the bound sheet bundle and binding of residual sheets with a large binding force.

Further, the sheet processing device described in Patent Document 3 has the plurality of binding sections. This results in an increase in size and complicated configuration, and a complicated control function is required to control operation of the enlarged and complicated configuration. Besides, in the first place, it is not easy to insert another binding section between the previously bound sheets.

The devices described in Patent Document 1 and Patent Document 2 need to be provided with a perforation forming unit for forming the perforation on the sheet, in addition to the stapler. This may enlarge the size of the entire device and complicate the device configuration and may require control for the device, including the perforation forming unit. This not only opposes the miniaturization and speeding-up of the device, which are recently required, but also poses a problem of high price.

SUMMARY OF THE INVENTION

The present invention has been made in view of the above problems in the conventional technology, and the object thereof is to provide a sheet bundle binding device provided with both a staple binding unit and a staple-free binding unit capable of performing binding operation with a binding force that a user desires and easily removing some sheets from the bound sheet bundle and an image forming system having such a sheet bundle binding device.

To achieve the above object, a sheet bundle binding device according to an aspect of the present invention includes: a processing tray that receives a plurality of sheets; a sheet accumulating mechanism that accumulates the plurality of sheets on the processing tray; a staple binding unit that binds the plurality of sheets on the processing tray into a sheet bundle using a staple needle; a staple-free binding unit having a pair of crimping toothed parts for staple-free binding the plurality of sheets on the processing tray into a sheet bundle; and a control section that performs drive control of the sheet accumulating mechanism, staple binding unit, and staple-free binding unit. The staple binding unit and the staple-free binding unit can apply first binding to a first sheet bundle accumulated on the processing tray by the sheet accumulating mechanism. The sheet accumulating mechanism can accumulate additional sheets on the first sheet bundle that has been subjected to the first binding to form a second sheet bundle. The staple-free binding unit can apply second binding to the second sheet bundle. The control section determines which one of the staple binding unit and staple-free binding unit is used to apply the first binding to the first sheet bundle.

As described above, in the sheet bundle binding device having both the staple binding unit and the staple-free binding unit, the control section determines whether or not to perform the first binding using the staple binding unit or staple-free binding unit, whereby two-stage binding can be controlled so that a sufficient binding force can always be given to the first and second sheet bundles that have been subjected to the first binding.

The control section can determine not to apply the first binding to the first sheet bundle. Thus, the binding can be controlled so as to prevent the first sheet bundle from being bound with an insufficient binding force by the first binding.

The control section can determine whether or not to apply the second binding to the second sheet bundle using the staple-free binding unit. Thus, two-stage binding can be controlled so that a sufficient binding force can be given to the second sheet bundle, that is, so as to prevent the second sheet bundle from being bound with an insufficient binding force.

The control section determines which one of the staple binding unit and the staple-free binding unit is used to perform the first binding or not to perform the first binding according to the magnitude of a binding force with which the first sheet bundle is bound by the first binding. It is already known that the maximum number of sheets or maximum thickness of a sheet bundle at which a required binding force can be obtained through the staple binding or staple-free binding varies depending on the property (thickness, hardness, etc.) of individual sheet. Thus, a sufficient binding force can be always ensured for the first sheet bundle by the control section operating in the manner described above.

The control section determines whether or not to perform the second binding according to the magnitude of a binding force with which the second sheet bundle is bound by the second binding. Thus, a sufficient binding force can always be given to the second sheet bundle, and it is possible to perform such control that additional sheets can be easily removed from the second sheet bundle.

The control section can move the staple binding unit and/or the staple-free binding unit relative to the first sheet bundle on the processing tray to which the first binding is applied and/or can move the staple-free binding unit relative to the second sheet bundle on the processing tray to which the second binding is applied. Thus, binding parts of the first and/or second binding can be formed at desired positions on the first sheet bundle and/or the second sheet bundle.

The staple binding unit can be moved in a direction perpendicular to a predetermined carry-out direction in which the first sheet bundle or the second sheet bundle is carried out from the processing tray along the side of the first sheet bundle on the opposite side to the predetermined carry-out direction. Thus, the staple binding can be performed at a desired position and, when needed, at a plurality of desired positions along the side of the first sheet bundle on the opposite side to the predetermined carry-out direction.

The control section drive-controls the sheet accumulating mechanism so as to move the first sheet bundle and/or the second sheet bundle on the processing tray in a direction perpendicular to a predetermined carry-out direction in which the first sheet bundle or the second sheet bundle is carried out from the processing tray. Thus, binding parts of the first and/or second binding can be formed at desired positions on the first sheet bundle and/or the second sheet bundle in the direction perpendicular to a predetermined carry-out direction.

The sheet bundle binding device further includes a sheet bundle carry-out mechanism that carries out the first sheet bundle or the second sheet bundle from the processing tray in a predetermined carry-out direction. The staple-free binding unit is disposed downstream of the staple binding unit in the predetermined carry-out direction, and the control section drive-controls the sheet bundle carry-out mechanism so as to move the first sheet bundle that has been subjected to the first binding or the second sheet bundle obtained by accumulating the additional sheets on the first sheet bundle from the staple binding unit side to the staple-free binding unit side for the second binding. Thus, after the first binding, it is possible to move the first sheet bundle or the second sheet bundle from the staple binding unit side to the staple-free binding unit side along the carry-out direction in which the sheet bundle carry-out direction carries out a sheet bundle so as to perform the second binding, whereby two-stage binding can be performed efficiently.

The control section drive-controls the sheet bundle carry-out mechanism so as to change the position of the second sheet bundle relative to the staple-free binding unit in order to adjust the magnitude of a binding force with which the second sheet bundle is bound through the second binding. Thus, the second binding can be controlled so that an adequate binding force corresponding to the thickness of the second sheet bundle can be obtained.

The sheet bundle binding device further includes a sheet bundle aligning mechanism that aligns a plurality of sheets accumulated on the processing tray into a sheet bundle. Thus, all the sheets constituting the first and second sheet bundles can be bound in an aligned state.

According to another aspect of the present invention, there is provided an image forming system including: an image forming unit that forms an image on a sheet; and a sheet bundle binding unit that accumulates a plurality of sheets fed from the image forming unit and applies binding to the accumulated sheets, the sheet bundle binding unit being any one of the above-described sheet bundle binding devices.

By including the above sheet bundle binding device of the present invention, there can be realized an image forming system that can bind a plurality of sheets on which an image is formed by the image forming unit in two stages of binding the first sheet bundle with a large binding force and binding a second sheet bundle composed of the first sheet bundle and additional sheets added to the first sheet bundle with a small binding force so as to allow the additional sheets to be easily removed from the second sheet bundle.

BRIEF DESCRIPTION OF THE DRAWINGS

FIG. 6A is an explanatory view illustrating a configuration of a staple-free binding unit, FIG. 6B is a partially enlarged view illustrating a binding part of a sheet bundle that has been subjected to staple-free binding, and FIG. 6C is an enlarged cross-sectional view taken along a line B-B in FIG. 6B;

DESCRIPTION OF THE PREFERRED EMBODIMENTS

Figure 1:
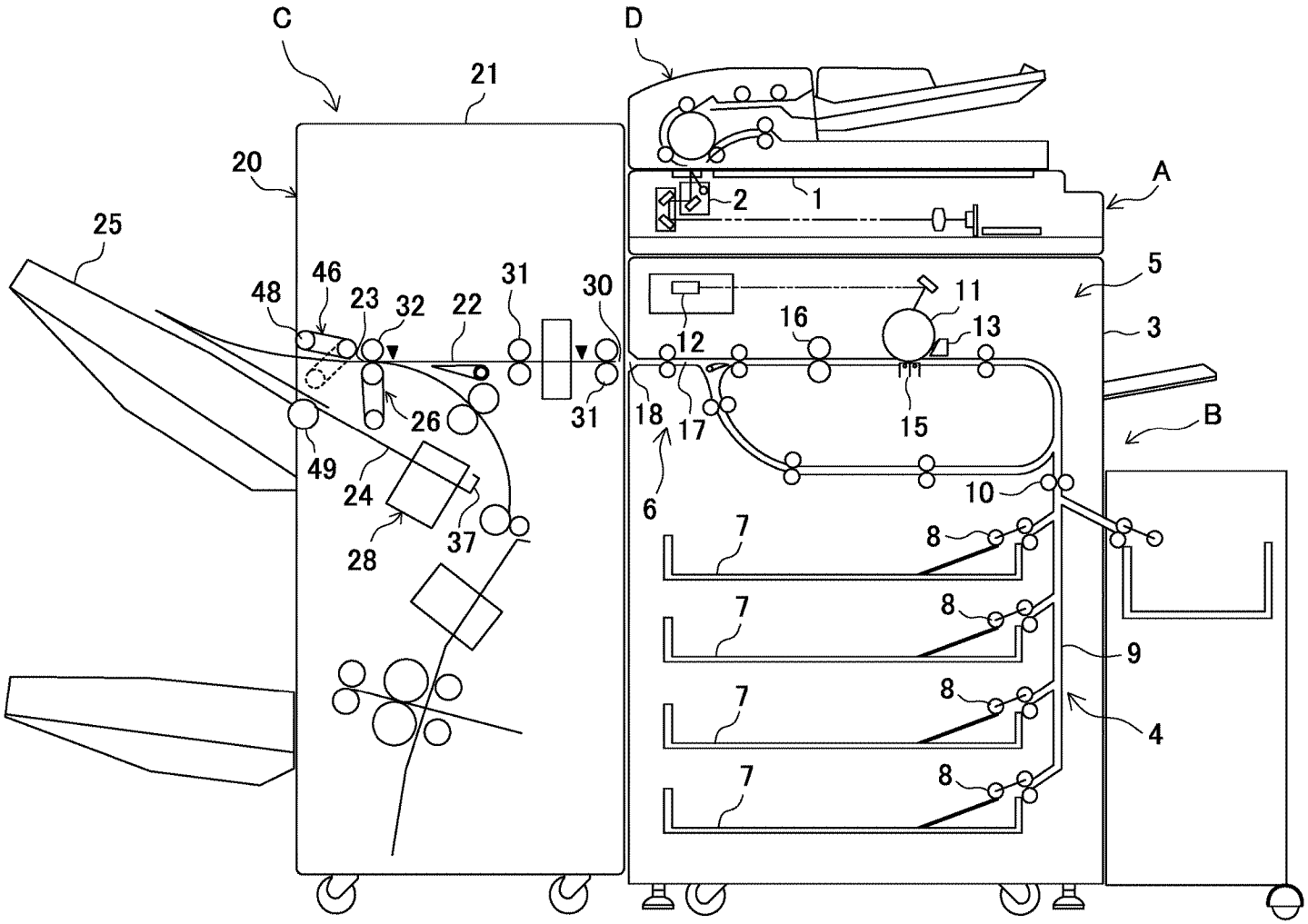
FIG. 1 is an explanatory view illustrating an entire configuration of an image forming system according to the present invention.

Hereinafter, a preferred embodiment of the present invention will be described in detail with reference to the accompanying drawings. Throughout the accompanying drawings, the same reference numerals are used to designate the same or similar components.

In the present specification, "sheet bundle offset conveyance" refers to movement (widthwise shifting) of a sheet bundle obtained by accumulating sheets carried in onto a processing tray from a discharge port in a direction perpendicular to (crossing) a sheet conveying direction, and "offset amount" refers to a movement amount of the widthwise shifting. Further, "alignment of sheet bundle" refers to alignment of a plurality of sheets having different sizes carried in onto a processing tray from a discharge port with reference to a predetermined position (for example, "center reference" which is to align the sheets with reference to the center position of the processing tray in a direction perpendicular to the sheet conveying direction (i.e., width direction) or "side reference" which is to align the sheets with reference to one side of the processing tray in the width direction thereof). For example, "to perform offset after aligning the sheets" refers to aligning a plurality of sheets having different sizes with reference to the predetermined position and then moving the aligned sheets to a direction perpendicular to the sheet conveying direction.

A sheet bundle binding device according to the present embodiment can perform binding for a sheet bundle obtained by aligning and accumulating a plurality of sheets on which an image is formed by an image forming system illustrated in FIG. 1 in two stages of proper binding and temporary binding. The proper binding refers to a binding state in which sheets of the bound sheet bundle are bound to each other with a strong binding force and cannot be easily peeled off (separated) from each other, and the temporary binding refers to a binding state in which sheets of the bound sheet bundle are bound to each other with a comparatively weak binding force and can be comparatively easily peeled off (separated) from each other.

The image forming system of FIG. 1 includes an image reading unit A, an image forming unit B, a post-processing unit C, and a document automatic feeding unit D. In the present specification, the near side of the image forming system in FIG. 1 is referred to as a device front side, and the far side thereof in FIG. 1 is referred to as a device rear side.

The image reading unit A includes a platen 1 formed of a transparent glass and a reading carriage 2 that is reciprocated along the platen 1 to read a document image. The document automatic feeding unit D feeds document sheets on a supply tray one by one to the platen 1, and the carriage 2 having a line sensor (photoelectric conversion element) arranged in a document width direction (main scan direction) is reciprocated in a sub scan direction perpendicular to the main scan direction to thereby read the document image in a line order.

The image forming unit B includes a supply section 4, an image forming section 5, and a discharge section 6 which are incorporated in a device housing 3 so as to form an image on a sheet based on image data of the document read by the image reading unit A. The supply section 4 supplies a sheet delivered by a supply roller 8 from a cassette 7 to the image forming section 5 through a supply path 9 according to an image forming timing of the image forming section 5.

During the sheet supply operation, the leading end of the sheet is aligned by a resist roller pair 10. The image forming section 5 includes, e.g., an electrostatic image forming mechanism. The image forming section 5 forms a latent image (electrostatic latent image) on a photoconductor drum 11 using a light emitter 12, attaches toner ink to the latent image using a developing unit 13, transfers the toner image onto a sheet using a transfer charger 15, fixes the toner image on the sheet using a fixing unit (heating roller) 16, and feeds the resultant sheet to the discharge section 6. The discharge section 6 guides the image-formed sheet along a discharge path 17 and carries out the sheet to the post-processing unit C through a discharge port 18.

The post-processing unit C includes a sheet bundle binding device 20 according to the present embodiment and has a function of accumulating and aligning a plurality of sheets carried out from the image forming unit B to make them into a sheet bundle, binding the sheet bundle, and storing the sheet bundle in a downstream side stack tray. The post-processing unit C of the present embodiment has a stand-alone structure independent of the image reading unit A and the image forming unit B, and the image reading unit A, image forming unit B, and post-processing unit C are connected by a network cable into one system. As another embodiment, the post-processing unit C may have an inner finisher structure. In this structure, the sheet bundle binding device 20 is incorporated, as a unit, in a sheet discharge space formed inside the device housing 3 of the image reading unit A.

Figure 2:
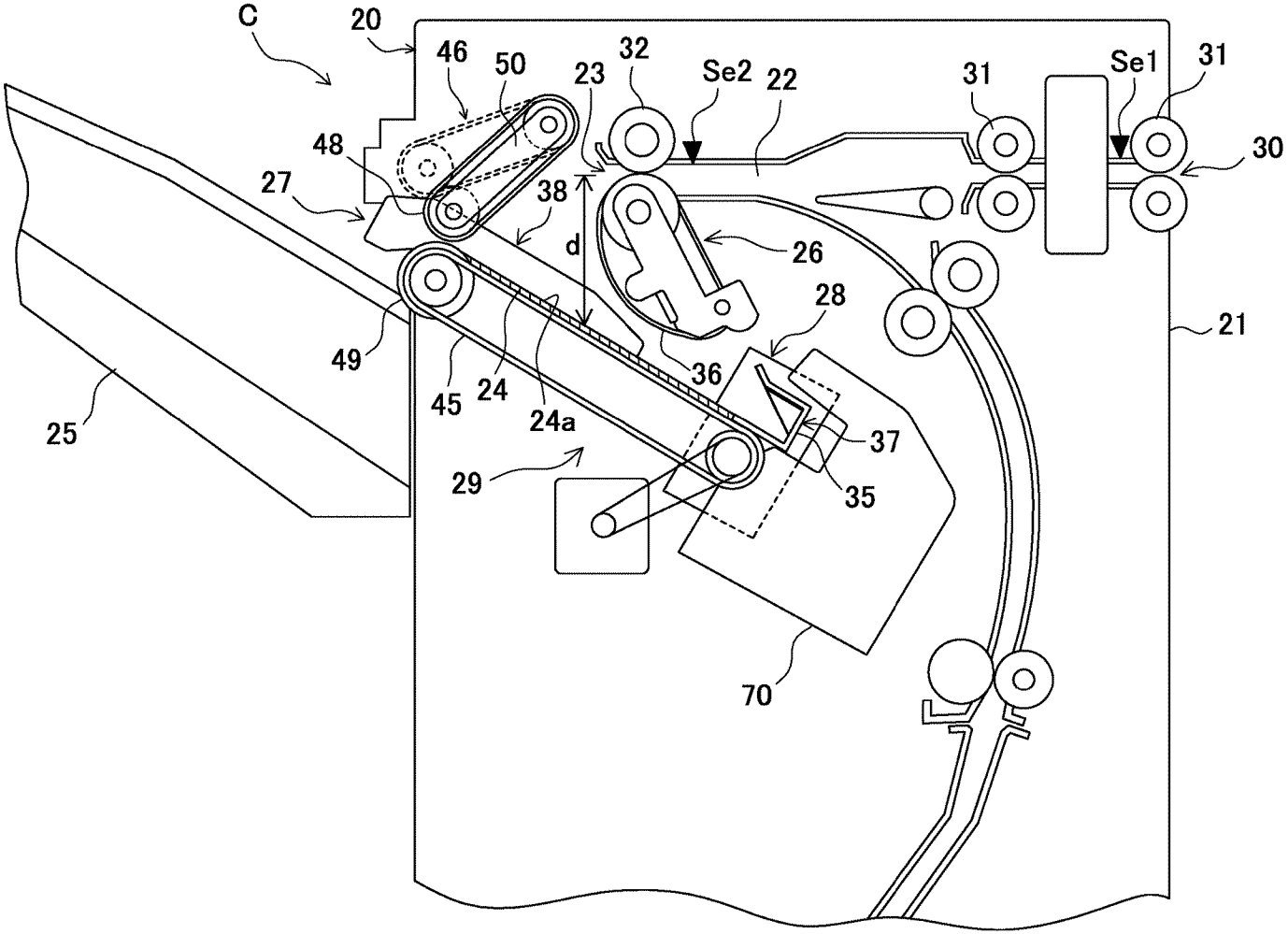
FIG. 2 is a side cross-sectional view of a post-processing unit of FIG. 1 as viewed from a device front side.

As illustrated in FIG. 2, the post-processing unit C includes a device housing 21, a discharge path 22 provided in the device housing 21, a processing tray 24 disposed downstream of a discharge port 23 of the discharge path 22, and a stack tray 25 disposed downstream of the processing tray 24. To execute the above-mentioned function of the post-processing unit C, there are provided in the processing tray 24 a sheet carry-in mechanism 26 for carrying a sheet discharged from the discharge port 23 to the back side of the processing tray 24, a sheet aligning mechanism 27 for accumulating a plurality of sheets carried in to configure a bundled form and aligning them, a binding mechanism 28 for staple-free binding the aligned sheet bundle, and a sheet bundle carry-out mechanism 29 for carrying out the bound sheet bundle to the stack tray 25.

The discharge path 22 includes a feeder mechanism in which conveying roller pairs such as a carry-in roller pair 31, a discharge roller pair 32, and the like are arranged at predetermined intervals so as to convey a sheet fed from the image forming unit B from a carry-in port 30 to the discharge port 23 in a substantially horizontal direction. Further, along the discharge path 22, sheet sensors Se1 and Se2 for detecting the leading end and/or rear end of a conveyed sheet are arranged.

As illustrated in FIG. 2, the processing tray 24 is disposed downstream of the discharge port 23 of the discharge path 22 with a level difference d below the discharge port 23. The processing tray 24 vertically stacks a plurality of sheets discharged from the discharge port 23 into a bundled form, i.e., a sheet bundle. To this end, the processing tray 24 includes a sheet placing face 24*a* for supporting at least a part of the sheet bundle. In the present embodiment, a structure (so-called a bridge support structure) that supports the front side of a sheet in the sheet carry-out direction by the stack tray 25 and supports the rear side thereof by the processing tray 24 is adopted. With this structure, the dimension of the entire tray is reduced in the carry-out (carry-in) direction.

The sheet carry-in mechanism 26 includes a conveying roller unit 46 so as to convey a sheet discharged from the discharge port 23 through the level difference d toward the back side of the processing tray 24 in a proper posture, (that is, with the left and right side edges of the sheet conveyed straight in the conveying direction) and smoothly. The conveying roller unit 46 includes a roller pair constituted of an upper conveying roller 48 and a lower driven roller 49 disposed with the processing tray 24 interposed therebetween. The conveying roller 48 is rotatably supported at the leading end of a bracket 50 swingably supported above the processing tray 24. The driven roller 49 is turnably provided at a fixed position immediately below the processing tray 24.

Figure 3A:
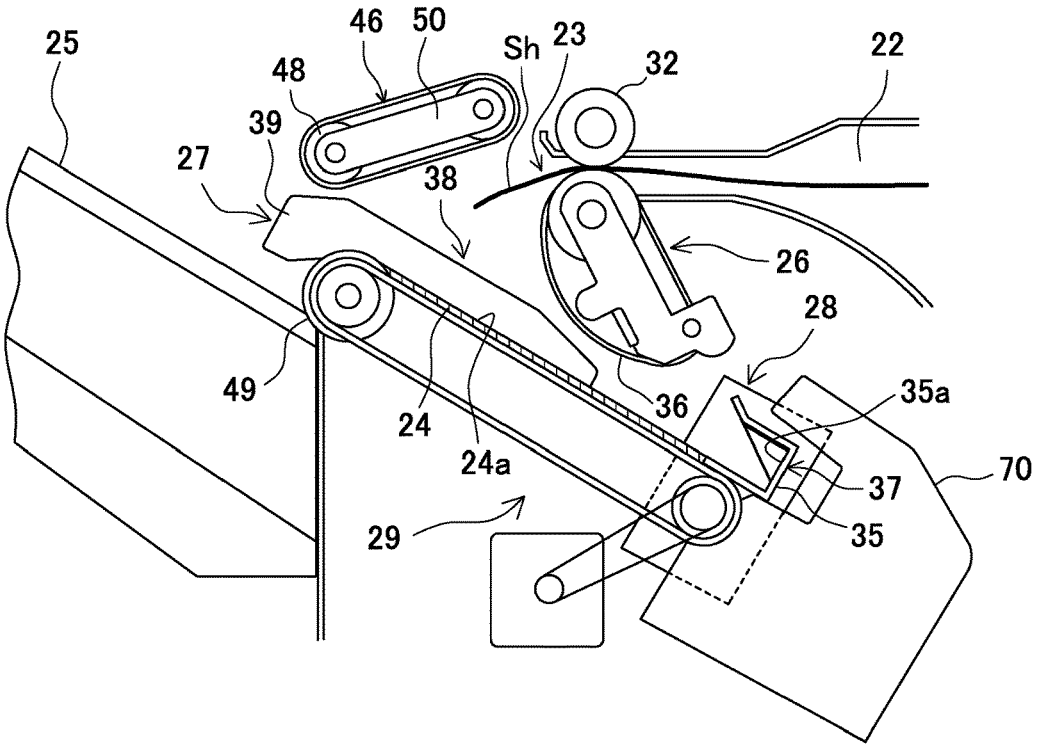
FIGS. 3A and 3B are explanatory views each illustrating a sheet carry-in mechanism of the post-processing unit of FIG. 1.
Figure 3B:
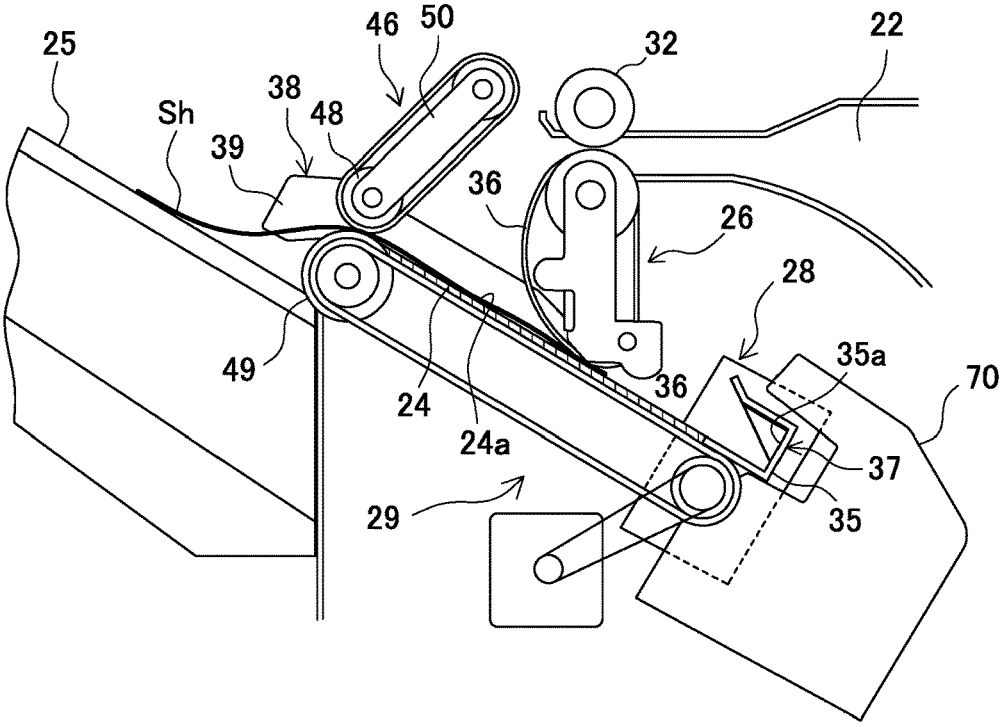

As illustrated in FIG. 3B, when the rear end of a sheet Sh discharged from the discharge port 23 reaches the processing tray 24, the bracket 50 is swung downward to cause the upper conveying roller 48 to abut against the upper surface of the sheet Sh on the processing tray 24. Then, the conveying roller 48 is belt-driven by a drive motor (not illustrated) into rotation in the counterclockwise direction in the drawing. As a result, the sheet Sh is conveyed on the processing tray 24 until the leading end (right end in the drawing) thereof abuts against a regulation member 35 in an opposite direction to the carry-in direction (that is, to the side opposite to the stack tray 25). As illustrated in FIGS. 3A and 3B, the regulation member 35 is a channel-shaped member having a U-like cross section and has, inside thereof, a regulation face 35*a* for stopping the sheet Sh conveyed on the processing tray 24 by making the leading end of the sheet Sh in the carry-in direction abut thereagainst.

The sheet carry-in mechanism 26 further includes a raking rotor 36 for guiding a sheet leading end to the regulation member 35 so as to cope with sheet curling or skewing which can occur when a sheet is conveyed to the regulation member 35 on the processing tray 24. The raking rotor 36 is a ring-shaped or short cylindrical belt member disposed above the processing tray 24 and in front of the regulation member 35 so as to be rotatable in the sheet carry-in direction. The belt member is engaged with the upper surface of a new sheet conveyed on the uppermost sheet of a sheet bundle stacked on the processing tray 24 and rotated in the counterclockwise direction in the drawing while pressing the leading end of the new sheet to convey the new sheet until it abuts the regulation face 35*a* of the regulation member 35.

The sheet aligning mechanism 27 is constituted of a sheet end regulation part 37 and a side aligning mechanism 38. The sheet end regulation part 37 has the above-mentioned regulation member 35 to regulate the carry-in direction (or carry-out direction) position of a sheet carried in onto the processing tray 24 from the discharge port 23 at the leading of the sheet in the carry-in direction (or rear end of the sheet in the carry-out direction). The side aligning mechanism 38 moves a sheet and a sheet bundle on the processing tray 24 in a direction perpendicular to the carry-in (or carry-out) direction, i.e., in the width direction to regulate the width direction position of the sheet or sheet bundle at the side end edge thereof to thereby align the sheet or sheet bundle in the width direction.

Figure 4:
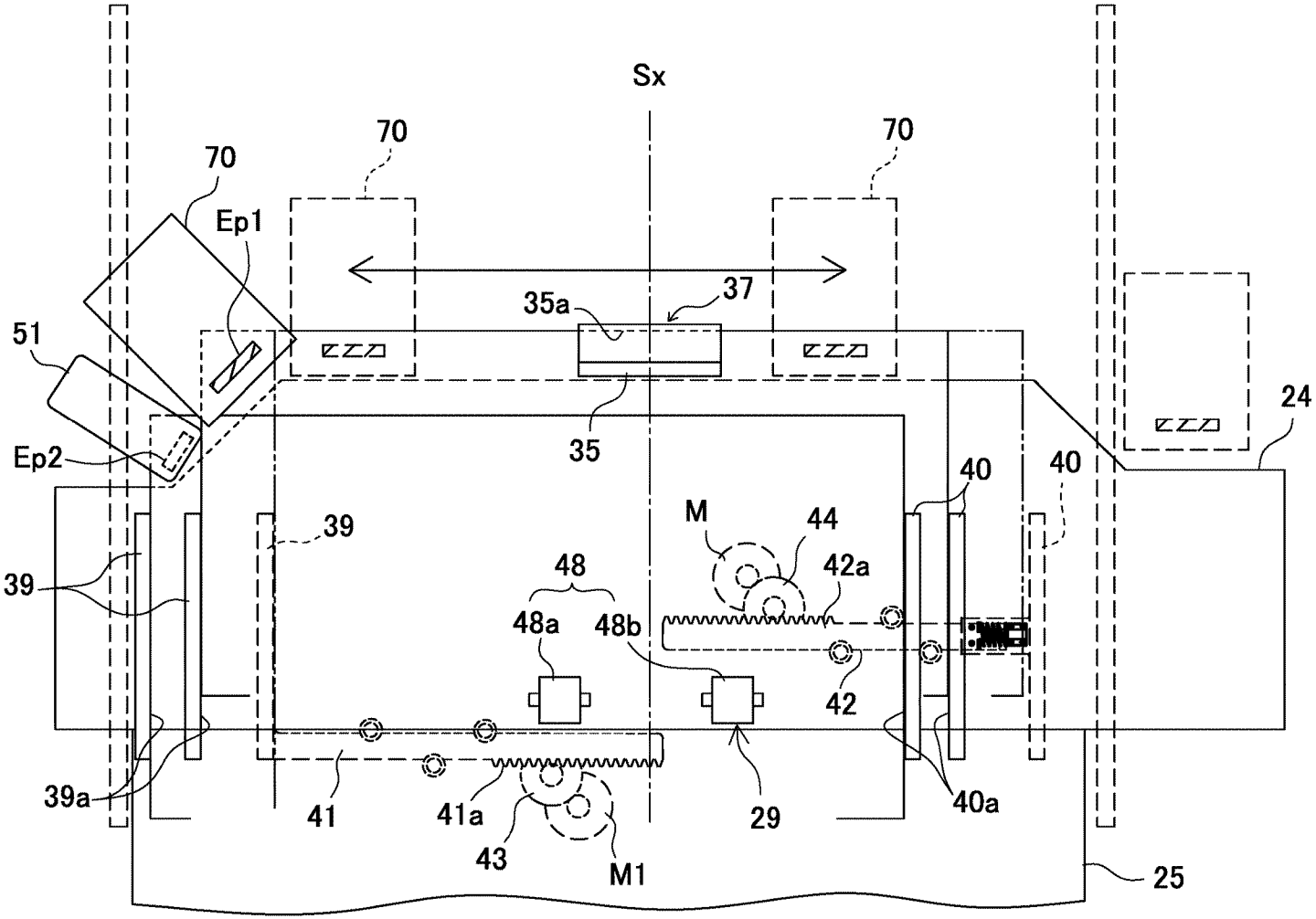
FIG. 4 is an explanatory view illustrating a processing tray of the post-processing unit of FIG. 2 as viewed from above a sheet placing face.

As illustrated in FIG. 4, the side aligning mechanism 38 has a pair of side aligning members 39 and 40 which are disposed left and right with a center reference line Sx interposed therebetween. The side aligning members 39 and are flat-plate like members extending upward from the sheet placing face 24*a* of the processing tray 24 with inner surfaces thereof facing each other. The inner surfaces of the respective side aligning members 39 and 40 function as regulation faces 39*a* and 40*a* which are engaged with adjacent width direction side end edges of the sheet Sh on the processing tray 24, respectively, to regulate the width direction position of the sheet Sh.

The side aligning members 39 and 40 are connected respectively to movable support parts 41 and 42 disposed on the back surface side of the processing tray 24 through width direction linear slits (not illustrated) formed penetrating the processing tray 24. By individually turning pinions 43 and 44 meshing respectively with racks 41*a* and 42*a* formed in the respective support parts 41 and 42 by respective driving motors M1 and M2, the side aligning members 39 and 40 can be moved independently of each other in the direction approaching each other or separating from each other and stopped at desired width direction positions. Thus, it is possible to individually set the positions of the side aligning members 39 and 40 in accordance with the size of a sheet to be carried in the processing tray 24 and, when a sheet bundle is moved in the width direction (offset conveyance), the positions and offset amounts thereof can be determined.

Figure 5A:
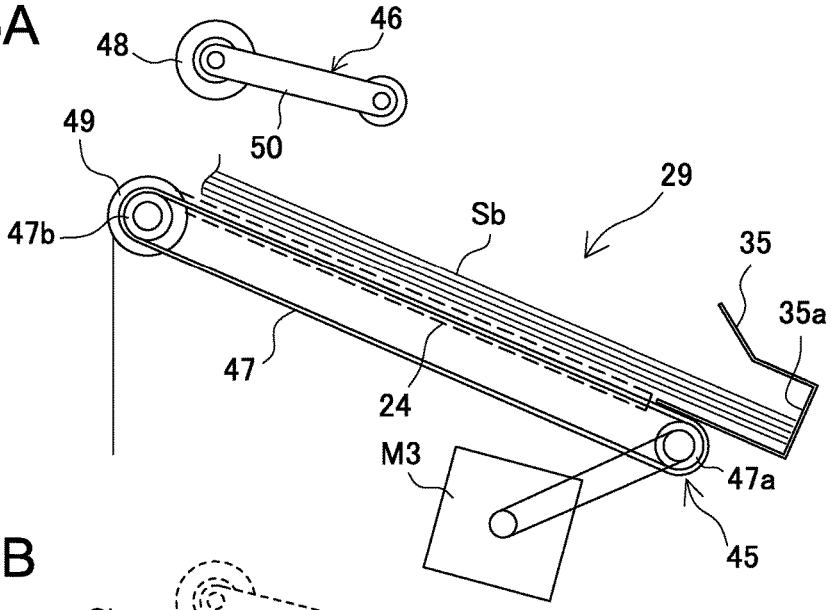
FIG. 5A is an explanatory view illustrating a standby state of a sheet bundle carry-out mechanism.
Figure 5B:
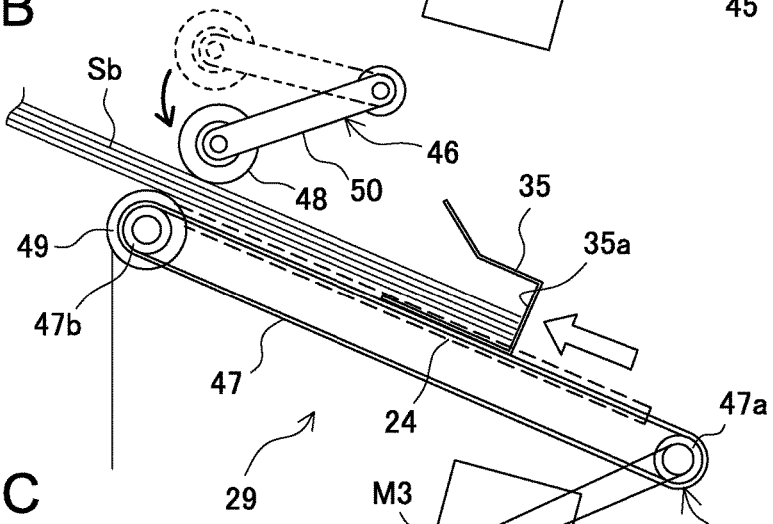
FIG. 5B is an explanatory view illustrating a sheet bundle conveying state.
Figure 5C:
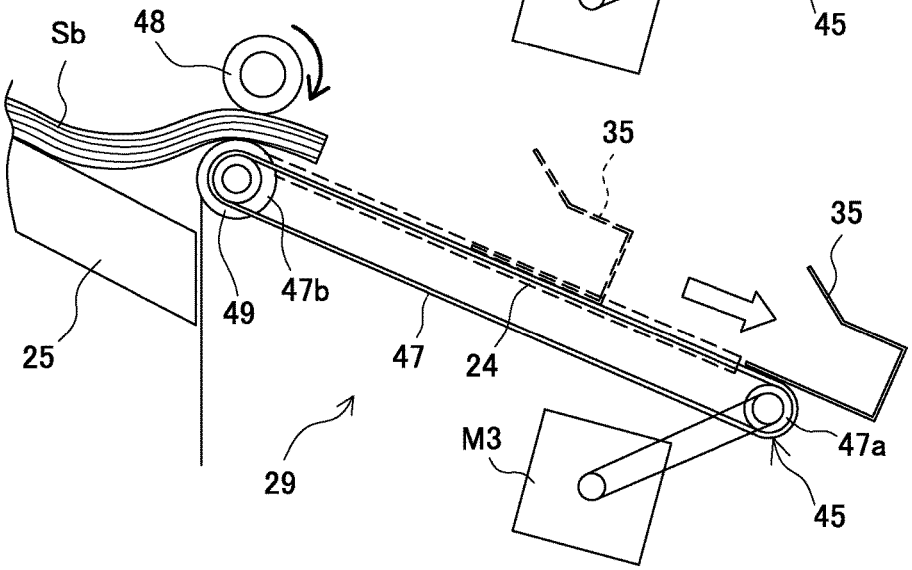
FIG. 5C is an explanatory view illustrating a sheet bundle discharge state to a stack tray.

As illustrated in FIGS. 5A to 5C, the sheet bundle carry-out mechanism 29 is constituted of a conveyer unit 45 and the above-mentioned conveying roller unit 46. The conveyer unit 45 has a conveyer belt 47 wound between a driving pulley 47*a* driven by a drive motor M3 and a driven pulley 47*b* and revolved in both clockwise and counterclockwise directions along the sheet carry-out direction. The conveyer belt 47 is fixed with the regulation member 35 that also functions as a push-out member that is moved along the sheet placing face 24*a* of the processing tray 24 to push out a sheet bundle Sb in the carry-out direction. As illustrated in FIG. 5A, the regulation member 35 can be moved in both forward and backward directions between an initial position of FIG. 5A near the rear end of the processing tray 24 in the carry-out direction and a maximum push-out position (denoted by a continuous line in FIG. 5B and by an imaginary line in FIG. 5C) which is substantially the intermediate position between the driving pulley 47*a* and driven pulley 47*b*.

The conveying roller unit 46 has a configuration in which the conveying roller 48 and the driven roller 49 sandwich the sheet bundle Sb from above and below near the front end of the processing tray 24 in the carry-out direction so as to be capable of conveying the sheet bundle Sb. In the conveying roller unit 46, left and right two pairs of rollers (conveying roller 48 and driven roller 49) are arranged symmetrically with respect to the center reference line Sx.

When a bound sheet bundle Sb is carried out from the processing tray 24 to the stack tray 25, the regulation face 35*a* of the regulation member 35 is made to abut against the rear end of the sheet bundle Sb in the carry-out direction, as illustrated in FIG. 5A. Then, the conveyer unit 45 is driven to move the regulation member 35 in the carry-out direction up to the maximum push-out position, whereby the sheet bundle Sb is pushed out in the carry-out direction to be moved on the processing tray 24 to the position illustrated in FIG. 5B. At the same time, the bracket 50 of the conveying roller unit 46 is rotated in the counterclockwise direction in the drawing to bring the left and right conveying rollers 48*a* and 48*b* into pressure contact with the upper surface of the sheet bundle Sb.

Then, the conveying roller 48 is rotated by, e.g., a drive motor (not illustrated) in the clockwise direction in the drawing to convey the sheet bundle Sb in the carry-out direction to thereby carry out the sheet bundle Sb on the processing tray 24 to the stack tray 25, as illustrated in FIG. 5C. The regulation member 35 of the conveyer unit 45 holds the entire sheet bundle Sb inside thereof with the regulation face 35*a* abutting against the rear end of the sheet bundle Sb and can thus be driven at a comparatively high speed. On the other hand, the conveying roller 48 makes a direct contact only with the uppermost surface of the sheet bundle Sb; therefore it is preferable that the conveying roller 48 be rotated at a comparatively low speed to gradually feed the sheet bundle Sb toward the stack tray 25. Then, the regulation member 35 is returned to the initial position by moving the conveyer belt 47 in the direction opposite to the carry-out direction.

The binding mechanism 28 includes a staple binding unit that binds a sheet bundle using a staple needle and a staple-free binding unit 51 that binds a sheet bundle without using a staple needle. When binding is performed in two stages of the proper binding and temporary binding, the proper binding can be performed by using either the staple binding unit 70 or staple-free binding unit 51, and, in either case, the temporary binding is performed by use of the staple-free binding unit 51.

As illustrated in FIG. 4, the staple binding unit 70 is installed so as to be movable in both directions along the side edge of the processing tray 24 on the back side thereof from the device front side to the device rear side. With this configuration, it is possible to bind a sheet bundle Sb1 on the processing tray 24 at a plurality of locations while moving the staple binding unit 70 along the side edge on the back side of the processing tray 24. When the staple binding unit 70 is used to staple-bind the sheet bundle Sb1 at one corner thereof, a binding position Ep1 on the sheet bundle Sb1 is set at the back side of the processing tray 24 in the carry-in direction and immediately outside a corner 24*b* thereof on the device rear side, i.e., left side in the drawing so as not to overlap with the processing tray 24.

The staple-free binding unit 51 is disposed slightly downward of the staple binding unit 70 in the sheet carry-out direction. Thus, a binding position Ep2 of the staple-free binding unit 51 is set immediately outside the corner 24*b* of the processing tray 24, so that the staple-free binding unit 51 can bind the sheet bundle Sb2 at a corner on the same side as that in the case of the staple binding.

The staple-free binding unit 51 according to the present embodiment is constituted of a crimping mechanism that presses a sheet bundle between crimping toothed parts each having a concave-convex surface into deformation to thereby bind the sheet bundle. As illustrated in FIG. 6A, the staple-free binding unit 51 has a configuration in which a movable frame member 53 is swingably supported to a base frame member 52 through a spindle 53*a*. The base frame member 52 has, at one end portion thereof, a lower crimping toothed part 54, and the movable frame member 53 has an upper crimping toothed part 55 at the position opposite to the lower crimping toothed part 54.

As illustrated in an enlarged manner in FIG. 6A, in the upper crimping toothed part 55, a plurality of rib-shaped protrusions 55*a* extending in the direction perpendicular to the teeth arrangement direction and a plurality of recessed grooves 56*a* each having a profile corresponding to the protrusion 55*a* are alternately formed. Similarly, in the lower crimping toothed part 54, a plurality of rib-shaped protrusions 54*a* extending in the direction perpendicular to the teeth arrangement direction and a plurality of recessed grooves 54*b* each having a profile corresponding to the protrusion 54*a* are alternately formed. The upper crimping toothed part 55 and the lower crimping toothed part 54 are disposed in such a way that the opposing projections and recessed grooves are engaged with each other.

With this configuration, a corner Sc of a sheet bundle Sb held and pressed between the upper crimping toothed part 55 and the lower crimping toothed part 54 can be deformed into a wave-plate shape in cross section as illustrated in FIGS. 6B and 6C, so that sheets constituting the sheet bundle Sb can firmly adhere to one another. In the present embodiment, as illustrated in FIG. 7B, the teeth arrangement direction of the upper crimping toothed part 55 and lower crimping toothed part 54 is disposed obliquely at a predetermined angle with respect to the center reference line Sx of the processing tray 24 so that the wave-plate shape of the binding part Sc is formed obliquely with respect to the sides of the sheet bundle Sb.

The movable frame member 53 integrally has a follower roller 56 at the end portion thereof on the opposite side to the upper crimping toothed part 55 with respect to the spindle 53*a*. The base frame member 52 integrally has a drive cam 57 which is an eccentric cam at the end portion thereof on the opposite side to the lower crimping toothed part 54. The follower roller 56 is disposed in such a way that a follower surface thereof is engaged with a cam surface of the drive cam 57.

An unillustrated spring member is disposed between the base frame member 52 and the movable frame member 53. The spring member biases the upper crimping toothed part 55 and the lower crimping toothed part 54 in such a direction that they are separated from each other, that is, in such a direction that the follower surface of the follower roller and the cam surface of the drive cam 57 are constantly engaged with each other. Therefore, when the drive cam 57 is driven by a motor M4, the movable frame member 53 is swung about the spindle 53*a* following the cam surface. With this configuration, the upper crimping toothed part 55 and the lower crimping toothed part 54 can be driven in such a way that they are engaged/brought into pressure contact with each other or separated from each other.

The presence of the spring member disposed between the base frame member 52 and the movable frame member 53 allows for a smooth and quick operation to separate the upper crimping toothed part 55 and the lower crimping toothed part 54 from a position where the bound sheet bundle is held under pressure. Further, the base frame member 52 may be provided with an unillustrated position sensor so as to detect whether the upper crimping toothed part 55 and lower crimping toothed part 54 are situated at the pressure-contact position or separated position. By receiving a signal representing a relative positional relationship between the upper crimping toothed part 55 and the lower crimping toothed part 54 from the position sensor, it is possible to perform peeling-off of the bound sheet bundle from the crimping toothed parts more smoothly and efficiently.

Figure 7:
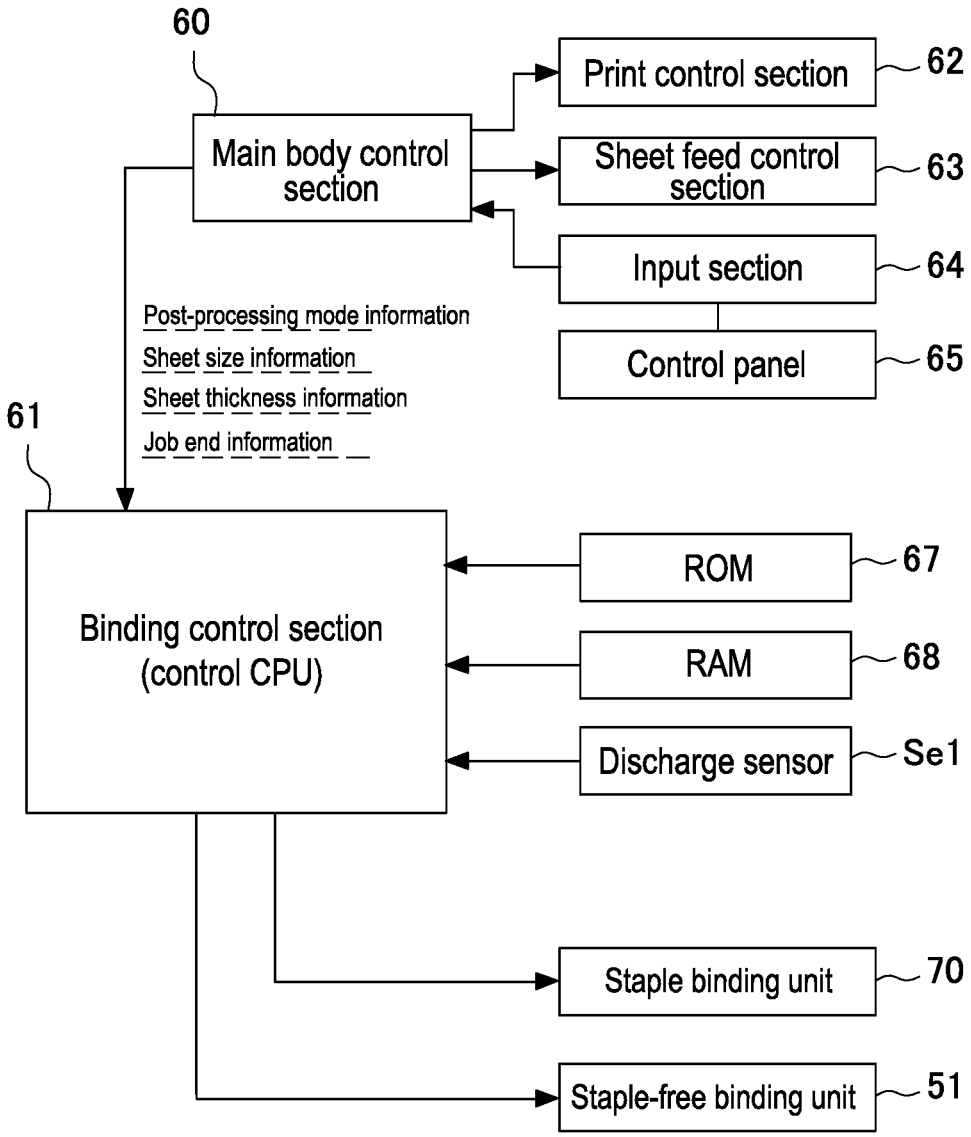
FIG. 7 is an explanatory view illustrating a control configuration of the image forming system of FIG. 1.

FIG. 7 schematically illustrates a control configuration of the image forming system of FIG. 1. The image forming system according to the present embodiment includes a main body control section 60 that controls the image forming unit B and a binding control section 61 that controls the post-processing unit C.

The main body control section 60 includes a print control section 62, a sheet feed control section 63, and an input section 65 connected to a control panel 64. The input section 65 can set an image forming mode and a post-processing mode through the control panel 64. In the image forming mode, printing modes such as color/monochrome printing and duplex/single-sided printing, and image forming conditions such as a sheet size, a sheet type, the number of print copies, and enlarged/reduced printing are set.

The post-processing mode includes a printout mode and a binding mode, one of which is selected by the user. The binding mode includes a normal mode in which only the proper binding is performed and a two-stage mode in which the proper binding and temporary binding are performed, and the user selects and sets one of these modes. Further, the two-stage mode includes a first pattern in which the proper binding is performed by means of the staple binding unit 70 and a second pattern in which the proper binding is performed by means of the staple-free binding unit 51, and the user selects and sets one of these modes. When the printout mode is selected, a sheet discharged from the discharge port 23 is stored in the stack tray 25 through the processing tray 24 without being subjected to the binding. In this case, sheets sequentially fed from the discharge port 23 can be stacked and accumulated on the processing tray 24 and then collectively carried out onto the stack tray 25 in response to a job end signal from the main body control section 60.

In the binding mode, a predetermined number of sheets discharged from the discharge port 23 are stacked and accumulated on the processing tray 24 into a bundle, then subjected to binding in the normal mode or two-stage mode, and carried out onto the stack tray 25. In the two-stage mode, the main body control section 60 transfers, to the binding control section 61, information indicating that the two-stage posit-processing mode has been selected and that the first pattern or second pattern has been selected for the proper binding, and, further, information such as the number of sheets constituting a sheet bundle to be subjected to first binding (proper binding), the number of sheets to be added for second binding (temporary binding) to the sheet bundle having been subjected to the first binding, the number of sheet bundles to be prepared, and a thickness of a sheet to be image-formed. Further, every time the image formation onto each sheet is ended, the main body control section 60 transfers the job end signal to the binding control section 61.

The binding control section 61 operates the post-processing unit C according to the setting of the post-processing mode input through the input section 65 of the main body control section 60. The binding control section according to the present embodiment includes a control CPU as a control unit. The control CPU is connected with a ROM 67 and a RAM 68. A sheet bundle binding operation and a sheet bundle discharge operation by the post-processing unit C are executed based on a control program stored in the ROM 67 and control data stored in the RAM 68. Thus, the control CPU 66 is connected to drive circuits of all the respective drive motors provided in the post-processing unit C.

In the case where the two-stage binding mode is selected and where the first pattern or second pattern is selected for the proper binding, the binding control section 61 refers to the number of sheets, sheet thickness, and the like set for the first binding and determines whether a staple needle of a size suitable for the proper binding can be used (when the first pattern is selected) and whether the thickness of the sheet bundle exceeds a range within which a binding force required for the proper binding can be obtained (when the second pattern is selected) based on the control data stored in the RAM 68. In both cases of the first and second patterns, when it is determined that the proper binding is impossible, the binding control section 61 notifies the user of the fact by displaying it on a display section (not illustrated) of the image forming system. In this case, the sheets conveyed from the image forming unit B to the post-processing unit C are carried out onto the stack tray 25 without being subjected to the binding.

In the case where the user selects the proper binding of the first pattern and it is determined that the proper binding of the first pattern is possible, the binding control section 61 executes the proper binding of the first pattern. In the case where the user selects the proper binding of the second pattern and it is determined that the proper binding of the second pattern is impossible while the proper binding of the first pattern is possible, the binding control section 61 notifies the user of the fact by displaying it on the display section of the image forming system.

In this case, when the user allows execution of the proper binding of the first pattern, the binding control section 61 executes not the proper binding of the second pattern, but proper binding of the first pattern. When the user does not allow execution of the proper binding of the first pattern, the binding control section 61 carries out the sheets which have been conveyed from the image forming unit B to the post-processing unit C onto the stack tray 25 without binding them.

Further, the binding control section 61 determines, based on the control data stored in the RAM 68, whether the thickness of a sheet bundle to be obtained by adding additional sheets to a sheet bundle to be subjected to the first binding for the second binding of temporary binding exceeds the range within which a binding force required for the temporary binding. When it is determined that the temporary binding is impossible, the binding control section 61 notifies the user of the fact by displaying it on the display section of the image forming system. In this case, the sheets conveyed from the image forming unit B to the post-processing unit C are subjected to only the first binding unless the user stops the binding operation. The additional sheets are carried out from the image forming unit B onto the stack tray 25 of the post-processing unit C without being subjected to the binding. When it is determined that the temporary binding is possible, the binding control section 61 successively executes the first binding (proper binding) and second binding (temporary binding).

In both cases of the proper binding of the first pattern and the proper binding of the second pattern, the binding control section 61 moves the left-side aligning members 39 on the staple-free binding unit 51 side to a retreated position (denoted by a continuous line in FIG. 4) near the binding position Ep before carry-in of sheets onto the processing tray 24. Further, the binding control section 61 moves the right-side aligning member 40 to a retreated position sufficiently separated from the center reference line Sx to the device front side so as not to obstruct movement of the sheets to be carried in onto the processing tray 24.

First, the two-stage binding of the first pattern in which the proper binding is performed by the staple binding unit 70 will be described. A process from a standby state in which the left- and right-side aligning members 39 and 40 are situated at their respective retreated positions to when a sheet bundle is stored on the processing tray 24 and subjected to the first binding will be described using FIGS. 8A to 8C. When a sheet Sh1 is discharged onto the processing tray 24 from the discharge port 23 of the device housing 21, the binding control section 61 detects the discharge of the sheet Sh1 based on signals from the discharge sensors Se1 and Se2 and activates the sheet carry-in mechanism 26. Then, the sheet Sh1 on the processing tray 24 is conveyed in the opposite direction to the carry-out direction toward the stack tray 25, that is, to the back of the processing tray 24. Then, as illustrated in FIG. 8A, the sheet Sh is conveyed by rotation of the raking rotor 36 until the leading end thereof in the carry-in direction abuts against the regulation face 35*a* of the regulation member 35.

Figure 8A:
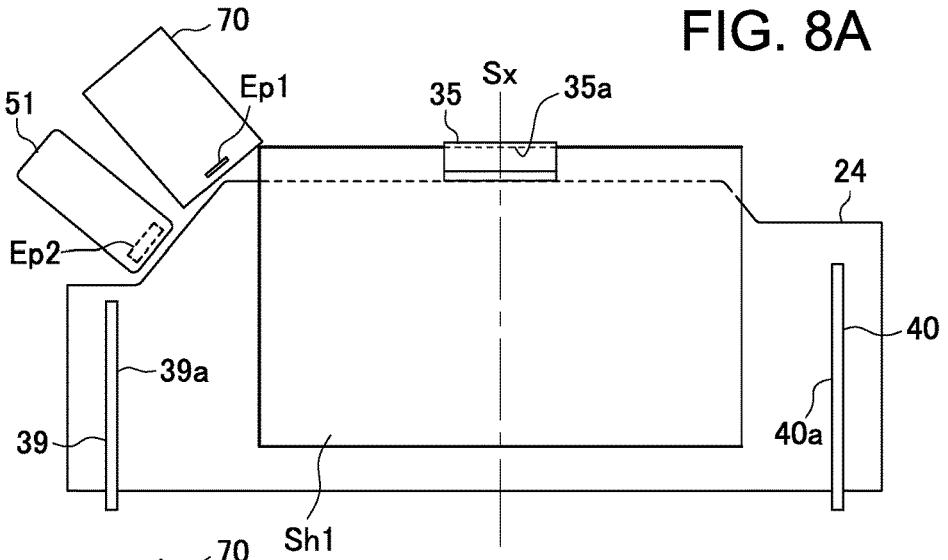
FIGS. 8A to 8C are explanatory views schematically illustrating a process of accumulating a sheet bundle carried in onto the processing tray and performing first binding as viewed from above the sheet placing face of the processing tray.
Figure 8B:
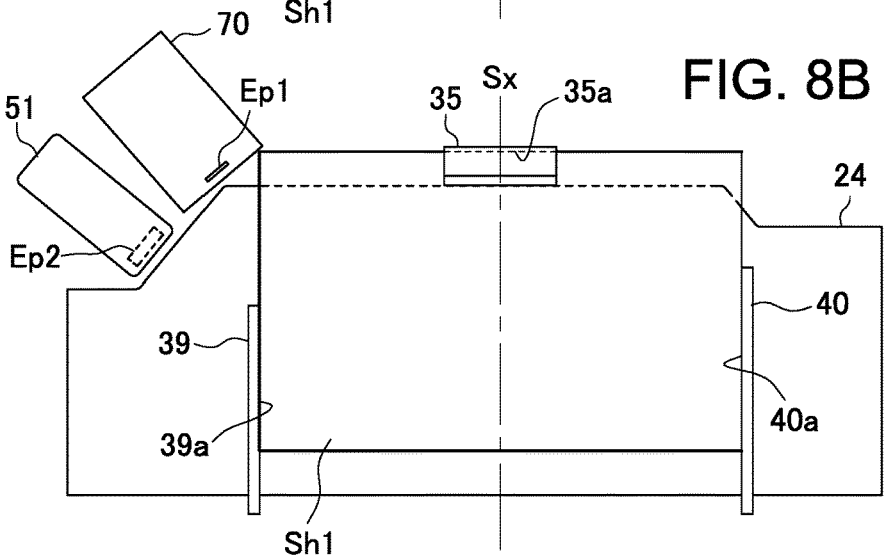

After the conveyance of the sheet Sh1 is stopped by the regulation member 35, the binding control section 61 moves inward the left- and right-side aligning members 39 and 40 situated at their respective retreated positions of FIG. 8A so as to sandwich the sheet Sh1 from both sides. The side aligning members 39 and 40 are moved until the regulation faces 39*a* and 40*a* thereof are engaged with the both side end edges of the sheet Sh1, that is, until the interval therebetween coincides with the width of the sheet Sh1. As a result, as illustrated in FIG. 8B, a plurality of sheets Sh1 are accumulated as a first sheet bundle while being aligned with an accumulating position where the center of the sheets Sh1 in the width direction coincides with the center reference line Sx. After that, the binding control section 61 returns the left- and right-side aligning members 39 and 40 to their respective retreated positions of FIG. 8A.

Figure 8C:
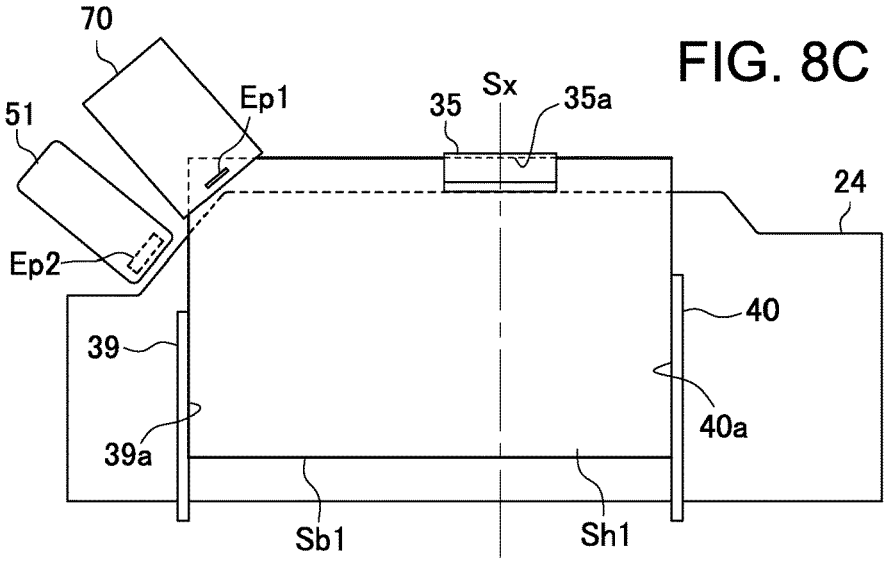

The above process illustrated in FIGS. 8A and 8B is repeated until a predetermined number of sheets constituting one sheet bundle to be subjected to the proper binding are accumulated on the processing tray 24 in the above-described aligned state. After the predetermines number of sheets Sh are aligned and accumulated on the processing tray 24, the binding control section 61 does not return the left- and right-side aligning members 39 and 40 to their respective retreated positions, but offset-moves the sheets Sh in the width direction toward a first binding position Ep1 as a first sheet bundle Sb1 while holding the sheet bundle Sb1 with the aligning members 39 and 40 from both sides, as illustrated in FIG. 8C. The left- and right-side aligning members 39 and 40 are stopped so that the side end edge of the first sheet bundle Sb1 on the device rear side slightly exceeds the first binding position Ep1 in the width direction.

Thus, the first sheet bundle Sb1 is positioned at a first binding position at which the corner Sc to be subjected to the proper binding completely includes the first binding position Ep1. Then, the binding control section 61 issues a command signal that causes the staple binding unit 70 to execute the first binding. After the binding, the staple binding unit 70 issues a binding end signal to the binding control section 61.

Figure 9A:
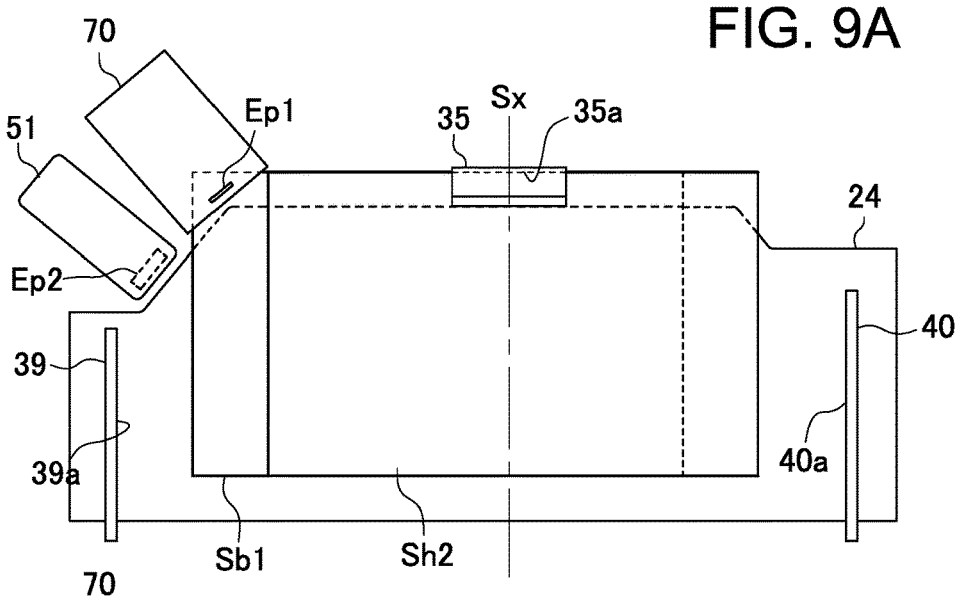
FIGS. 9A and 9C are explanatory views schematically illustrating a process of accumulating succeeding sheets on the sheet bundle that has been subjected to the first binding and performing second binding as viewed from above the sheet placing face of the processing tray.
Figure 9B:
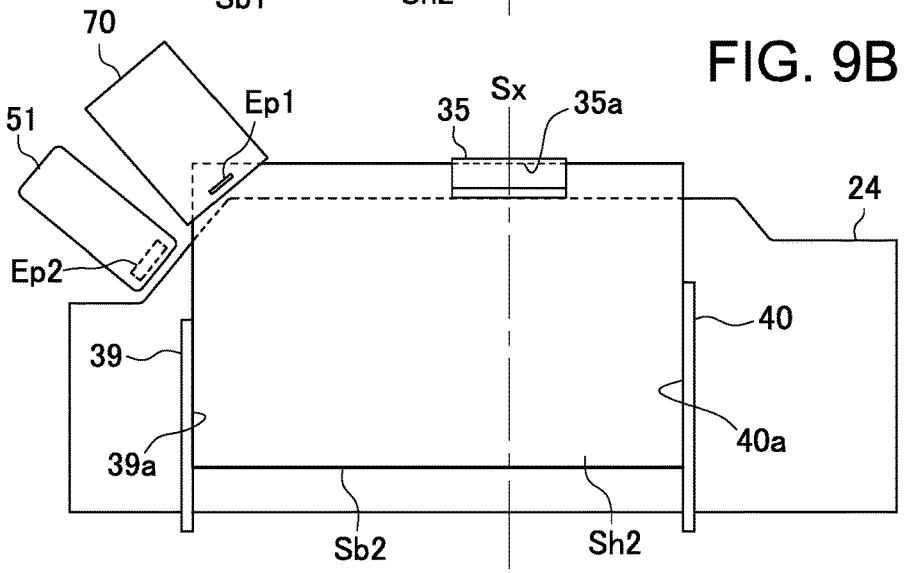
Figure 9C:
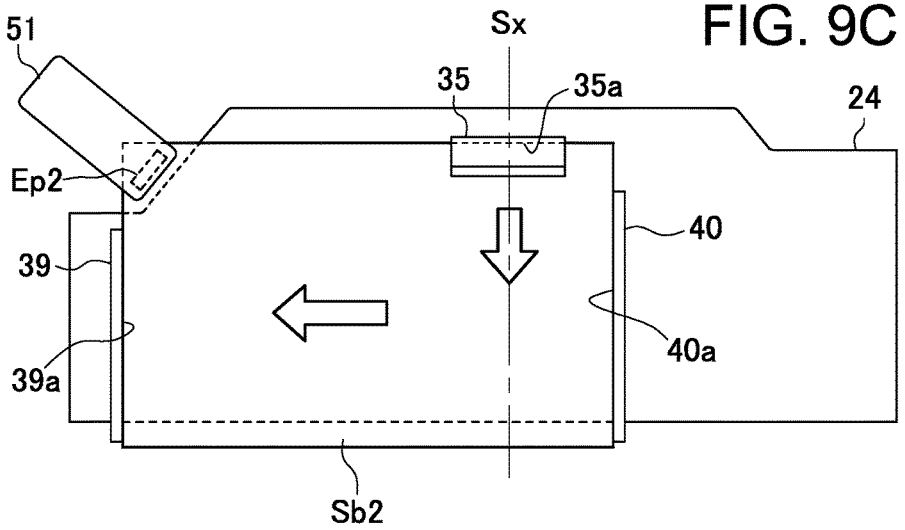

Upon reception of the binding end signal from the staple binding unit 70, the binding control section 61 performs the second binding for temporary binding of additional sheets with the first sheet bundle Sb1 that has been subjected to the proper binding. FIGS. 9A to 9C illustrate a process up to execution of the second binding for the first sheet bundle Sb1.

As illustrated in FIG. 9A, the binding control section 61 returns the left- and right-side aligning members 39 and 40 to their respective retreated positions of FIG. 8A. Then, the binding control section 61 detects an additional sheet Sh2 discharged onto the processing tray 24 from the discharge port 23 of the device housing 21 from signals output from the discharge sensors Se1 and Se2 and then activates the sheet carry-in mechanism 26 to feed the sheet Sh2 on the first sheet bundle Sb1 to the back of the processing tray 24. The additional sheet Sh2 is conveyed by rotation of the raking rotor 36 until the leading end thereof in the carry-in direction abuts against the regulation face 35*a* of the regulation member 35.

After the carry-in of the additional sheet Sh2 is stopped by the regulation member 35, the binding control section 61 moves inward the left- and right-side aligning members 39 and 40 from their respective retreated positions of FIG. 8A so as to sandwich the additional sheet Sh2 from both sides. Thus, as illustrated in FIG. 9B, a plurality of additional sheets Sh2 are stacked on the first sheet bundle Sb1 situated at the first binding position Ep1. Thereafter, the binding control section 61 returns the left- and right-side aligning members 39 and 40 to their respective retreated positions.

The above process illustrated in FIGS. 9A and 9B is repeated until a predetermined number of additional sheets Sh2 are accumulated on the processing tray 24 in the above-described aligned state. In this manner, the predetermined number of additional sheets Sh2 are aligned and accumulated on the first sheet bundle Sb1 stacked on the processing tray 24. The resultant sheet bundle including the first sheet bundle Sb1 and additional sheets Sh2 is referred to as a second sheet bundle Sb2.

Then, the binding control section 61 does not return the left- and right-side aligning members 39 and 40 to their respective retreated positions but drives the conveyer unit 45 to move the regulation member 35 as the push-out member in the carry-out direction with the second sheet bundle Sb2 sandwiched between the left- and right-side aligning members 39 and 40 from both sides thereof to push out the second sheet bundle Sb2 in the carry-out direction by a predetermined distance. The regulation member 35 is stopped so that the rear end edge of the second sheet bundle Sb2 in the sheet carry-out direction is situated at the position slightly rearward of the second binding position Ep2 in the carry-out direction.

Further, with the second sheet bundle Sb2 sandwiched between the left- and right-side aligning members 39 and 40 from both sides thereof, the binding control section 61 offset-moves the left- and right-side aligning members 39 and 40 in the width direction toward the second binding position Ep2. The left- and right-side aligning members 39 and 40 are stopped so that the side end edge of the second sheet bundle Sb2 on the device rear side slightly exceeds the second binding position Ep2 in the width direction. Thus, as illustrated in FIG. 9C, the second sheet bundle Sb2 is positioned at a second binding position at which the corner Sc to be subjected to the temporary binding completely includes the second binding position Ep2.

Then, the binding control section 61 issues a command signal that causes the staple-free binding unit 51 to execute the second binding (staple-free binding). In response to the command signal, the staple-free binding unit 51 presses and deforms the corner Sc of the second sheet bundle Sb2 into the wave-plate shape of FIG. 6C in cross section in all the range of the mutually meshing upper crimping toothed part 55 and lower crimping toothed part 54 as illustrated in FIG. 6B to thereby bind the second sheet bundle Sb2.

Figure 10A:
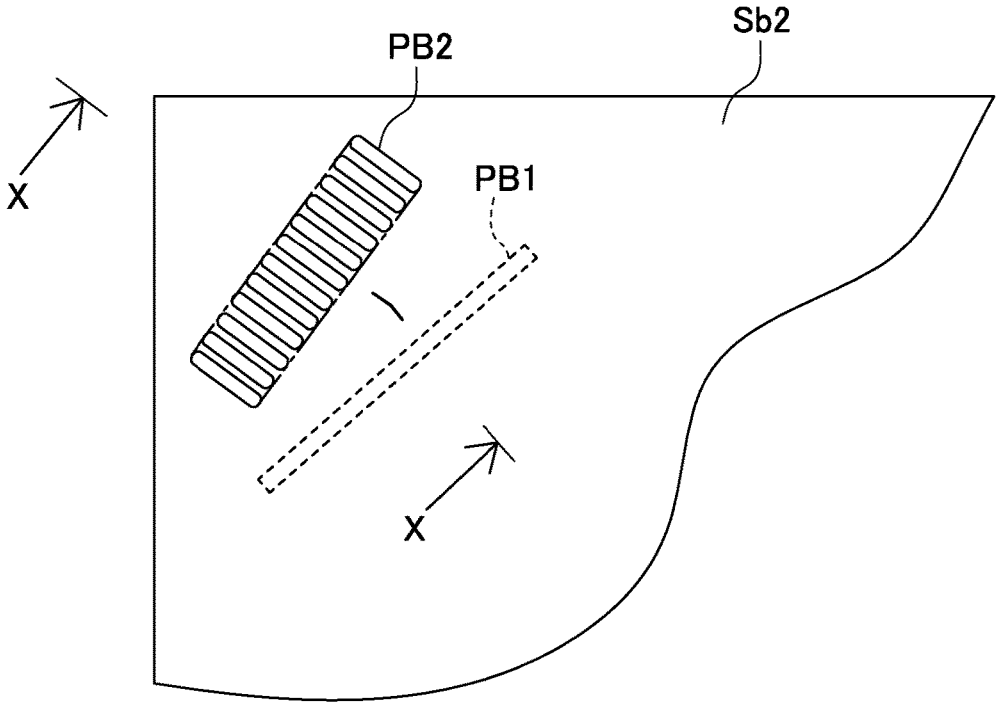
FIG. 10A is a partially enlarged plan view illustrating a binding part of a sheet bundle that has been subjected to the second binding.
Figure 10B:
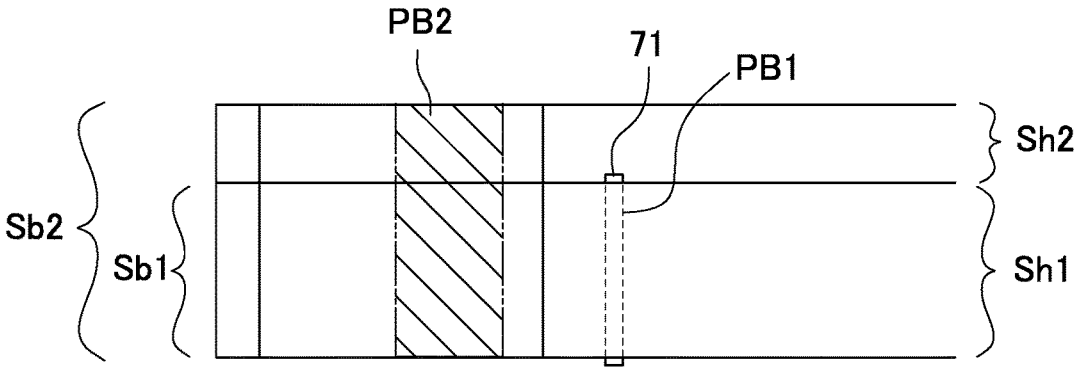
FIG. 10B is a cross-sectional view taken along a line X-X in FIG. 10A.

FIGS. 10A and 10B illustrate, in a partially enlarged manner, binding states of a first binding part PB1 of the first sheet bundle Sb1 that has been subjected to the proper binding through the first binding and a second binding part PB2 of the second sheet bundle b2 obtained by applying the temporary binding to the additional sheets Sh2 through the second binding. As described above, at the first binding part PB1, the sheets are subjected to the proper binding with a staple needle 71, so that a large binding force is exhibited.

On the other hand, at the second binding part PB2, the sheets are subjected to the press-binding, so that the binding force at the second binding part PB2 is smaller than that at the first binding part PB1, so that the additional sheets Sh2 can be easily removed from the second sheet bundle Sb2.

As illustrated in FIG. 10A, the staple needle 71 is driven obliquely with respect to the side of the first sheet bundle Sb1. The staple needle 71 slightly protrudes from the upper surface of the first sheet bundle Sb1, so that the first additional sheet accumulated on the first sheet bundle Sb1 may fail to be properly accumulated due to warping, curling, or deviation in direction thereof caused by the end edge of the first additional sheet being caught by the protrusion of the staple needle 71. In the present embodiment, by driving the staple needle 71 obliquely with respect to the side of the first sheet bundle Sb1, the first additional sheet can be prevented from being caught by the protrusion or can easily be removed therefrom if caught, whereby the first and subsequent additional sheets can always be accumulated in an aligned state on the first sheet bundle Sb1.

In general, when a certain number of sheets are pressed and bound under the same pressure, a binding force for binding the sheet bundle is increased/decreased depending on the size of an area of the binding part. For example, the second binding part PB2 is formed such that the upper crimping toothed part 55 and lower crimping toothed part 54 cross the side edge of the second sheet bundle Sb2 so that the second sheet bundle Sb2 is pressed and bound not over the entire range of the upper crimping toothed part 55 and lower crimping toothed part 54 but in a partial range thereof. Thus, the binding force at the second binding part PB2 is made smaller, so that the additional sheets can be removed from the second sheet bundle Sb2 more easily.

Figure 14A:
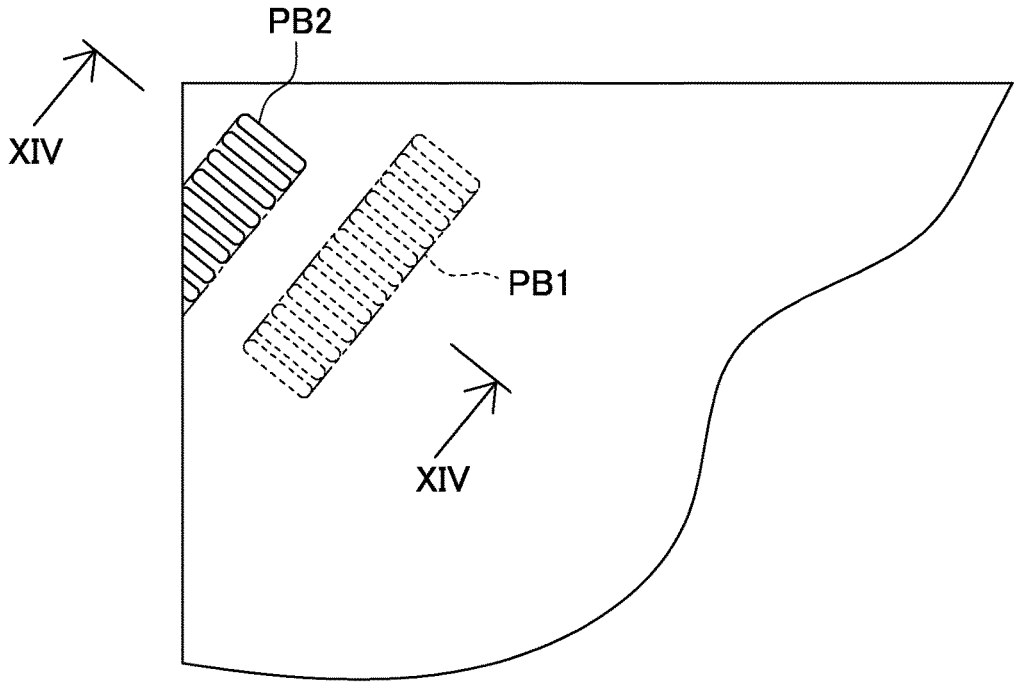
FIG. 14A is a partially enlarged plan view illustrating a binding part of a sheet bundle that has been subjected to the second binding.

Thus, the binding control section 61 determines, based on the thickness of the second sheet bundle Sb2, whether a desired binding force can be obtained. When the binding force at the second binding part PB2 is too large to remove the additional sheets easily, the second binding position is adjusted as illustrated in FIG. 14A. That is, the second binding part PB2 is formed such that the upper crimping toothed part 55 and lower crimping toothed part 54 cross the side edge of the second sheet bundle Sb2 so that the second sheet bundle Sb2 is pressed and bound in a partial range thereof. This is achieved by, for example, controlling movement of the second sheet bundle Sb2 by the regulation member 35 and/or left- and right-side aligning members 39 and 40 in the state of FIG. 9C.

Alternatively, the size of the area of the second binding part PB2 can be adjusted by moving the staple-free binding unit 51. To this end, the staple-free binding unit is provided so as to be movable with respect to the processing tray 24. Further alternatively, it is possible to adjust the binding force at the second binding part PB2 by controlling the staple-free binding unit 51 in accordance with the number of sheets of the second sheet bundle Sb2 and/or the number of additional sheets so as to increase/decrease a pressurizing force between the upper crimping toothed part 55 and lower crimping toothed part 54.

It is easier to peel off the sheet in an arrangement direction of the waves of the wave-plate shape than to peel off the sheet in a direction along the ridge line of the waves. Thus, by forming the second binding part PB2 such that the wave ridge line direction substantially coincides with an acting direction of the peeling-off operation, the sheet is not peeled off easily. Conversely, by forming the second binding part PB2 such that the wave ridge line direction crosses (especially, crosses at right angles) the acting direction of the peeling-off operation, the sheet can be peeled off from the sheet bundle comparatively easily.

For example, when the binding part is disposed at a corner of the sheet bundle, an operation of turning pages of the sheet bundle may often be conducted diagonally from its diagonally opposite corner. In the present embodiment, as illustrated in FIG. 10A, the second binding parts PB2 formed at a corner is disposed in such a way that the wave ridge line thereof is substantially directed to its diagonally opposite corner and, accordingly, the additional sheet Sh2 is not peeled off easily by a normal page-turning operation. In this case, by intentionally peeling off the additional sheet Sh2 in the direction crossing the direction of the normal page-turning operation, the sheet can be removed from the sheet bundle easily.

The same is applied to a case where the binding part is formed along the side edge of the sheet bundle. For example, when the press-binding part is disposed along the left long side of a sheet bundle, the page-turning operation may be conducted from the right to the left in general. Therefore, when the biding part is formed such that the wave arrangement direction substantially coincides with the long side direction of the sheet bundle, the sheet is not peeled off easily by a normal page-turning operation; on the other hand, by intentionally peeling off the sheet in the direction crossing the direction of the normal page-turning operation, the sheet can be removed from the sheet bundle easily.

Further, it is found that when an end portion of the press-binding part in the wave arrangement direction contacts the side edge of the sheet bundle, the sheet is peeled off easily even when the page turning operation is conducted along the wave arrangement direction. Thus, when the second binding part is formed in such a way that the end portion thereof in the wave arrangement direction contacts the edge of the side from which the pages of the sheet bundle are often turned, the sheet is not peeled off easily by a normal page-turning operation; on the other hand, by intentionally peeling off the sheet in a direction opposite to or crossing the direction of the normal page-turning operation, the sheet can be removed from the sheet bundle easily.

Thus, even when the binding control section 61 press-binds the second sheet bundle Sb2 over the entire range of the upper crimping toothed part 55 and lower crimping toothed part 54 as described above, the second binding position can be adjusted so that the end portion of the second binding part PB2 contacts the side of the second sheet bundle Sb2. This is achieved by controlling movement of the second sheet bundle Sb2 by the regulation member 35 and/or left- and right-side aligning members 39 and 40 in the state of FIG. 9C.

Further, when a binding imprint of the second binding part PB2 remains on an opened sheet surface of the first sheet bundle Sb1 after removal of the additional sheets Sh2 from the second sheet bundle Sb2, there may occur not only appearance deterioration, but also some adverse effect, such as deterioration in quality of an image formed on that surface. Further, when the second binding part PB2 is present at the opening side of the sheet, the binding force by the second binding part PB2 may obstruct smooth page-turning or opening operation of the first sheet bundle Sb1 even after the removal of the additional sheets.

Thus, the second binding part PB2 preferably comes closer to the side of the second sheet bundle Sb2 in proximity to the first binding part PB1 than the first binding part PB1 comes. Thus, after removal of the additional sheets Sh2 from the second sheet bundle Sb2, the first sheet bundle Sb1 can smoothly be opened or turned without being obstructed by the second binding part PB2 and the binding imprint thereof.

In the present embodiment, as illustrated in FIG. 10A, the first binding part PB1 and the second binding part PB2 are disposed at the same corner Sc of the second sheet bundle Sb2, and the second binding part PB2 is disposed outside the first binding part PB1, that is, disposed on the opposite side to the center of the sheet surface with respect to the first binding part PB1. Thus, the second binding part PB2 preferably comes closer to the sheet conveying direction and width direction both sides of the second sheet bundle Sb2 in proximity to the first binding part PB1 than the first binding part PB1 comes. As a result, the first sheet bundle Sb1 can smoothly be opened or turned. In addition, adverse effects that the second binding part PB2 and the binding imprint thereof can have on an image formed on the opened sheet surface of the first sheet bundle Sb1 and on the appearance of the sheet surface can be eliminated or reduced.

Figure 11A:
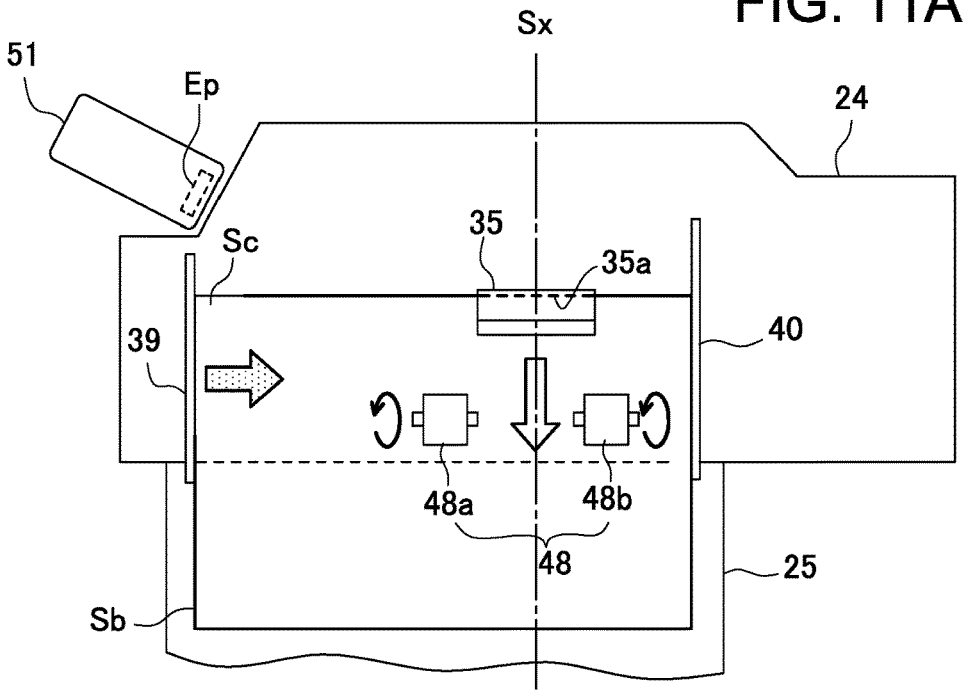
FIGS. 11A and 11B are explanatory views schematically illustrating a process of discharging the sheet bundle that has been subjected to the second binding to the stack tray as viewed from above the sheet placing face of the processing tray.

After the second binding illustrated in FIG. 9B, the staple-free binding unit 51 separates the upper crimping toothed part 55 and the lower crimping toothed part 54 from each other and issues a binding end signal to the binding control section 61. The binding control section 61 drives the conveyer unit 45 to move the regulation member 35 in the carry-out direction. The regulation member 35 is moved up to the maximum push-out position illustrated in FIG. 5B while pushing out the second sheet bundle Sb2, as illustrated in FIG. 11A and stopped there. At the same time, the binding control section 61 lowers the two brackets 50 of the conveying roller unit 46 to bring the left and right conveying rollers 48 into pressure contact with the upper surface of the second sheet bundle Sb2. The regulation member 35 is returned to the initial position illustrated in FIG. 8A.

Figure 11B:
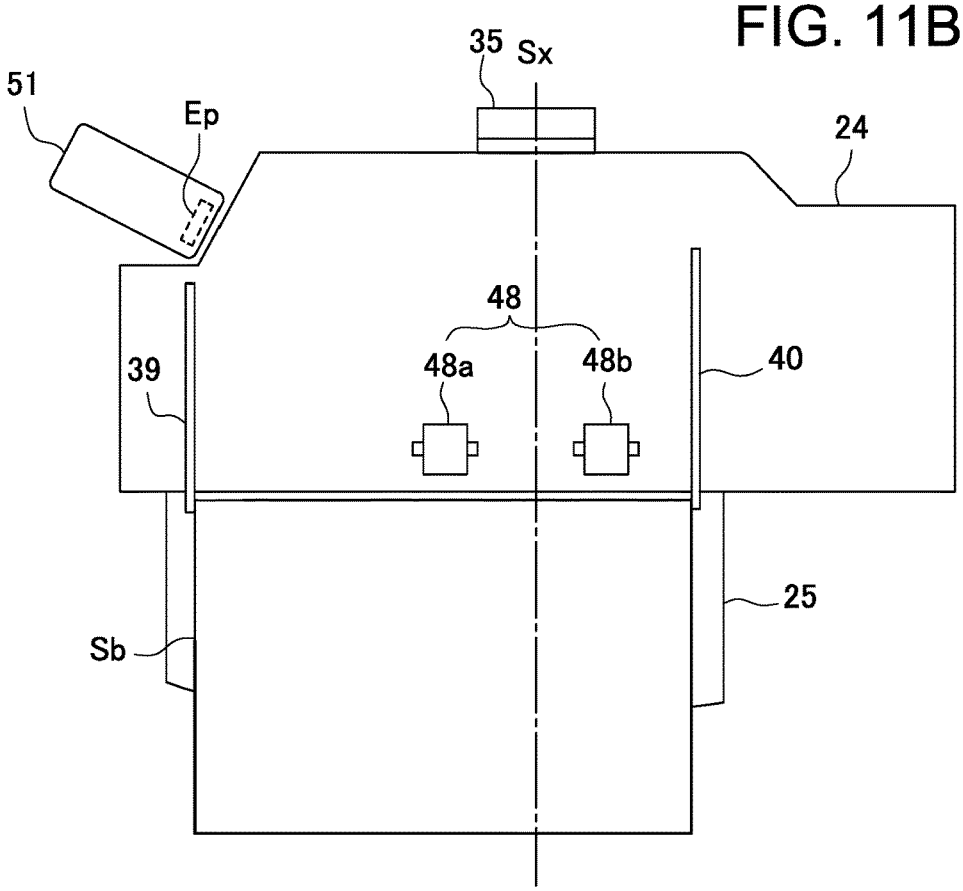

Further, the binding control section 61 rotates the two conveying rollers 48 to convey the second sheet bundle Sb2 in the carry-out direction from the processing tray 24 to the stack tray 25, as illustrated in FIG. 11B. At this time, in order to prevent the uppermost sheet of the second sheet bundle Sb2 from slipping on the lower side sheet, the conveying rollers 48 are preferably rotated at a comparatively low speed to gradually feed the sheet bundle Sb to the stack tray 25.

At this time, as illustrated in FIGS. 11A and 11B, the regulation member 35 and two conveying rollers 48 of the present embodiment are significantly displaced from the center of the second sheet bundle Sb2 in the width direction. However, the left and right both end edges of the second sheet bundle Sb2 are regulated by the left- and right-side aligning members 39 and 40, so that the second sheet bundle Sb2 keeps a straight posture with respect to the carry-out direction while it is carried out by the regulation member 35 and two conveying rollers 48.

Figure 12A:
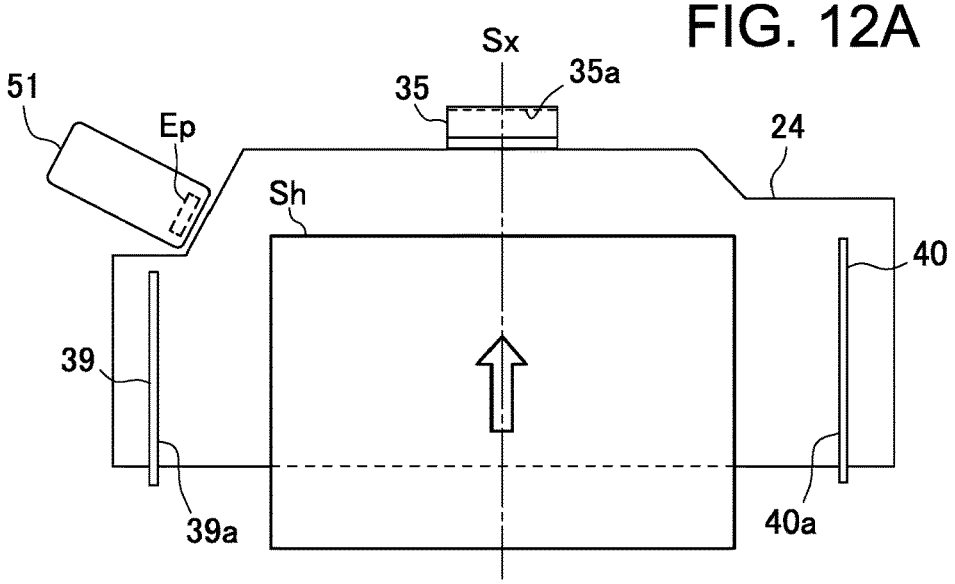
FIGS. 12A to 12C are explanatory views schematically illustrating a process of accumulating a sheet bundle carried in onto the processing tray and performing first binding as viewed from above the sheet placing face of the processing tray.

Next, the two-stage binding of the second pattern in which the proper binding is performed by the staple-free binding unit 51 will be described. As in the description of the first pattern, a process of accumulating a sheet bundle on the processing tray 24 and performing the first binding will be described using FIGS. 12A to 12E. As illustrated in FIG. 12A, the left-side aligning member 39 is situated at its retreated position in proximity to the binding position Ep, and the right-side aligning member 40 is situated at its retreated position sufficiently separated from the center reference line Sx to the device front side.

When a sheet Sh1 is discharged on the processing tray 24 from the discharge port 23 of the device housing 21, the binding control section 61 detects the discharge of the sheet Sh1 from a signal output from the discharge sensor Se1 and activates the sheet carry-in mechanism 26. Then, the sheet Sh1 on the processing tray 24 is conveyed in the opposite direction to the carry-out direction toward the stack tray 25, that is, to the back of the processing tray 24. Then, as illustrated in FIG. 12B, the sheet Sh is conveyed by rotation of the raking rotor 36 until the leading end thereof in the carry-in direction abuts against the regulation face 35*a* of the regulation member 35.

After the conveyance of the sheet Sh is stopped by the regulation member 35, the binding control section 61 moves inward the left- and right-side aligning members 39 and 40 situated at their respective retreated positions of FIG. 12A so as to sandwich the sheet Sh1 from both sides. The side aligning members 39 and 40 are moved until the regulation faces 39*a* and 40*a* thereof are engaged with the both side end edges of the sheet Sh1, that is, until the interval therebetween coincides with the width of the sheet Sh1. As a result, as illustrated in FIG. 12C, a plurality of sheets Sh1 are accumulated as a first sheet bundle while being aligned with an accumulating position where the center of the sheets Sh1 in the width direction coincides with the center reference line Sx of the processing tray 24. After that, the binding control section 61 returns the left- and right-side aligning members 39 and 40 to their respective retreated positions of FIG. 12A.

Figure 12B:
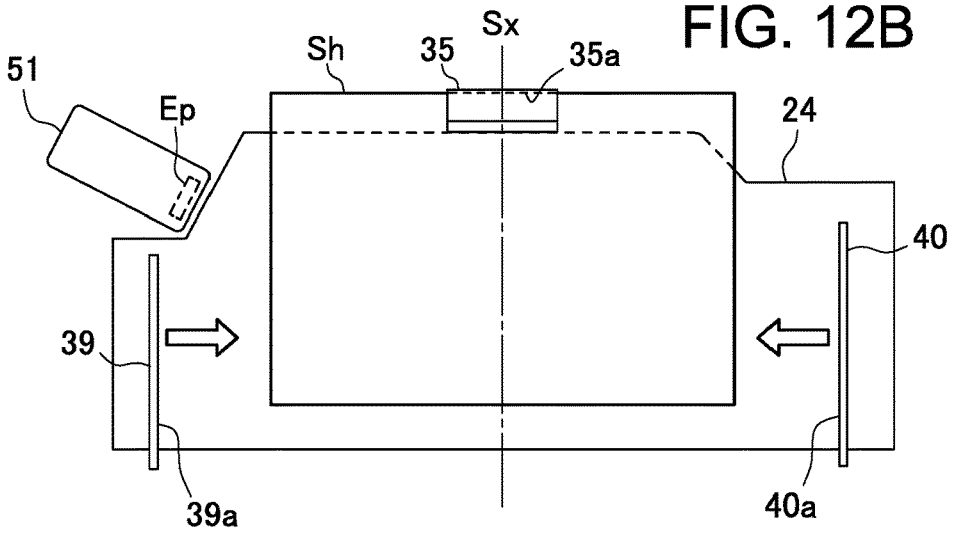
Figure 12C:
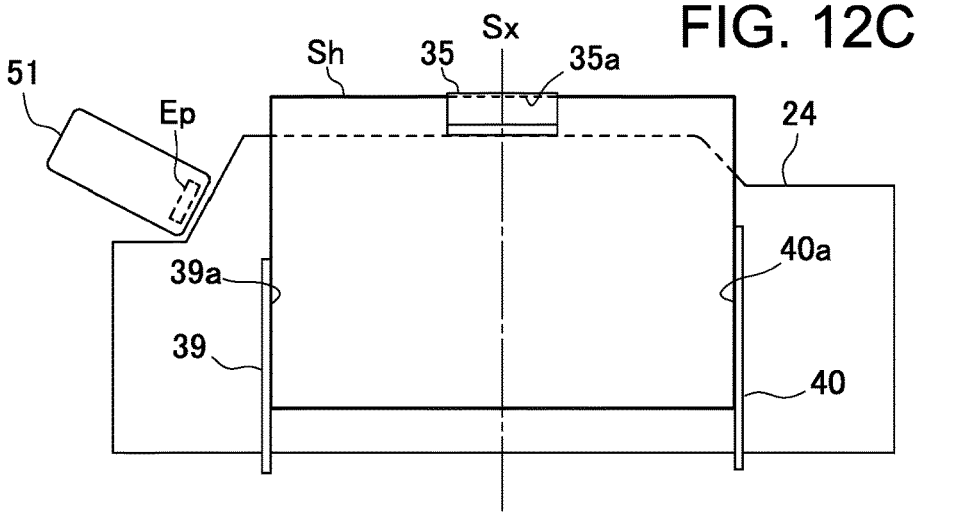
Figure 12D:
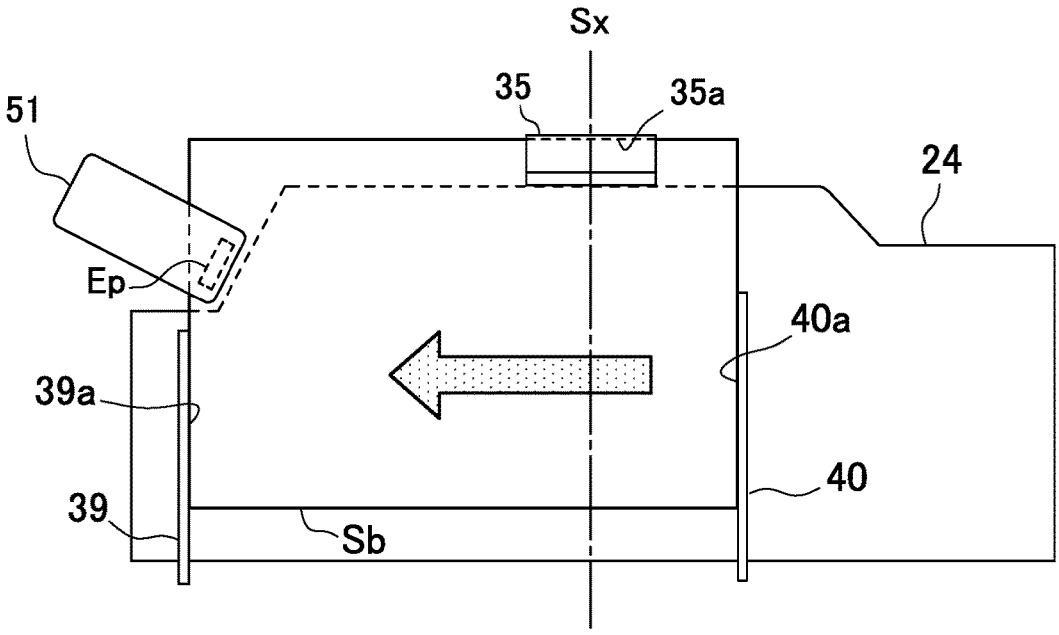
FIGS. 12D and 12E are explanatory views schematically illustrating a process of accumulating a sheet bundle carried in onto the processing tray and performing first binding as viewed from above the sheet placing face of the processing tray.

The above process illustrated in FIGS. 12A to 12C is repeated until a predetermined number of sheets constituting one sheet bundle to be subjected to the proper binding are accumulated on the processing tray 24 in the above-described aligned state. After the predetermined number of sheets Sh are aligned and accumulated on the processing tray 24, the binding control section 61 does not return the left- and right-side aligning members 39 and 40 to their respective retreated positions, but, as illustrated in FIG. 12D, offset-moves the sheets Sh in the width direction toward the binding position Ep as a first sheet bundle Sb1 while holding the sheet bundle Sb1 with the aligning members 39 and 40 from both sides. The left- and right-side aligning members 39 and 40 are stopped so that the side end edge of the first sheet bundle Sb1 on the device rear side slightly exceeds the binding position Ep in the width direction.

Figure 12E:
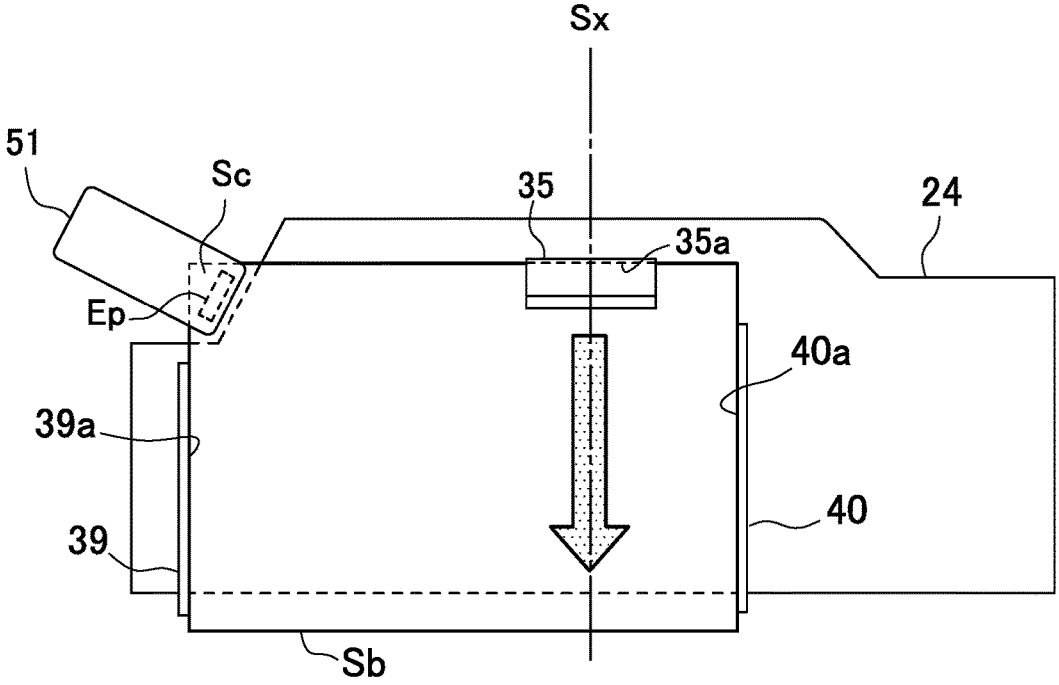

At the position illustrated in FIG. 12D, the side end edge of the first sheet bundle Sb1 on the device rear side is disposed between the upper crimping toothed part 55 and the lower crimping toothed part 54 of the staple-free binding unit 51 in a separated state so as to be sufficiently separated therefrom. In this state, the binding control section 61 drives the conveyer unit 45 of the sheet bundle carry-out mechanism 29 to move the regulation member 35 as the push-out member in the carry-out direction to push out the first sheet bundle Sb1 in the carry-out direction by a predetermined distance. The regulation member 35 stops the side end edge of the first sheet bundle Sb1 slightly before the binding position Ep in the carry-out direction. As a result, as illustrated in FIG. 12E, the first sheet bundle Sb1 is positioned at a first binding position where the corner Sc to be subjected to the proper binding completely includes the binding position Ep.

Then, the binding control section 61 issues a command signal that causes the staple-free binding unit 51 to execute first staple-free binding. In response to the command signal, as illustrated in FIG. 6B, the staple-free binding unit 51 presses and deforms the corner Sc of the first sheet bundle Sb1 into a wave-plate shape in cross section as illustrated in FIG. 6C over the entire range of the mutually meshing upper crimping toothed part 55 and the lower crimping toothed part 54 to thereby bind the first sheet bundle Sb1. After the binding, the staple-free binding unit 51 separates the upper crimping toothed part 55 and lower crimping toothed part 54 from each other and issues a binding end signal to the binding control section 61.

Upon reception of the binding end signal from the staple-free binding unit 51, the binding control section 61 performs the second binding for temporarily binding additional sheets into the first sheet bundle Sb1 that has been subjected to the proper binding. FIGS. 13A to 13D illustrate a process up to execution of the second binding for the first sheet bundle Sb1.

Figure 13A:
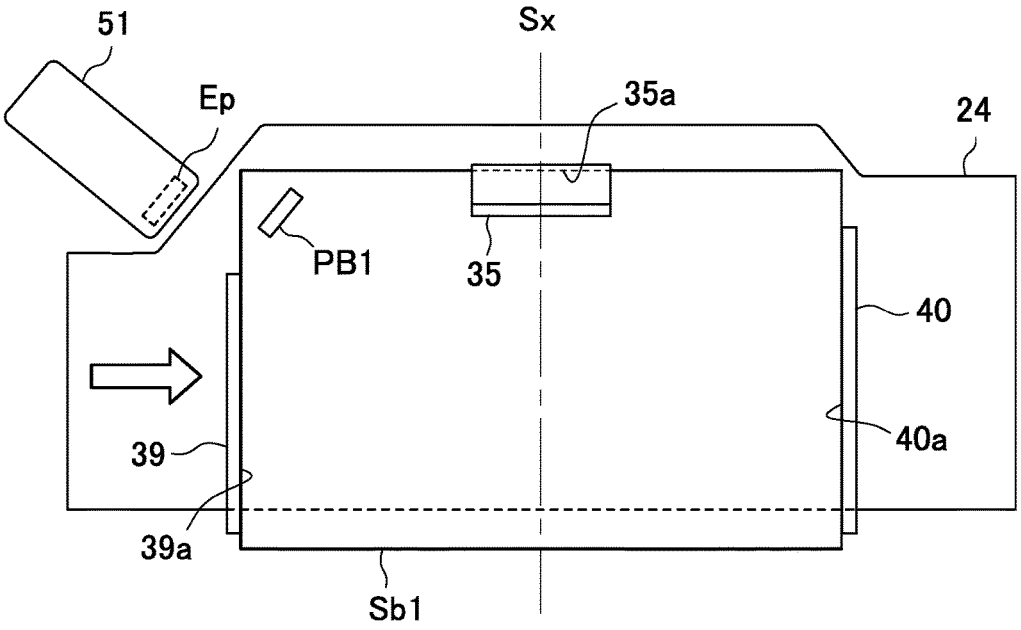
FIGS. 13A and 13B are explanatory views schematically illustrating a process of accumulating succeeding sheets on the sheet bundle that has been subjected to the first binding and performing second binding as viewed from above the sheet placing face of the processing tray.

As illustrated in FIG. 13A, upon reception of the first binding end signal from the staple-free binding unit 51, the binding control section 61 moves the left- and right-side aligning members 39 and 40 to the side opposite to the binding position Ep in the width direction while holding the first sheet bundle Sb1 with the aligning members 39 and 40 from both sides to return the aligning members 39 and 40 to the accumulating position where the center of the first sheet bundle Sb1 in the width direction coincides with the center reference line Sx. After that, the left- and right-side aligning members 39 and 40 are moved to their respective retreated positions illustrated in FIG. 12A. At this time, the regulation member 35 is maintained at the position illustrated in FIG. 12E where it has been moved for the first binding.

Figure 13B:
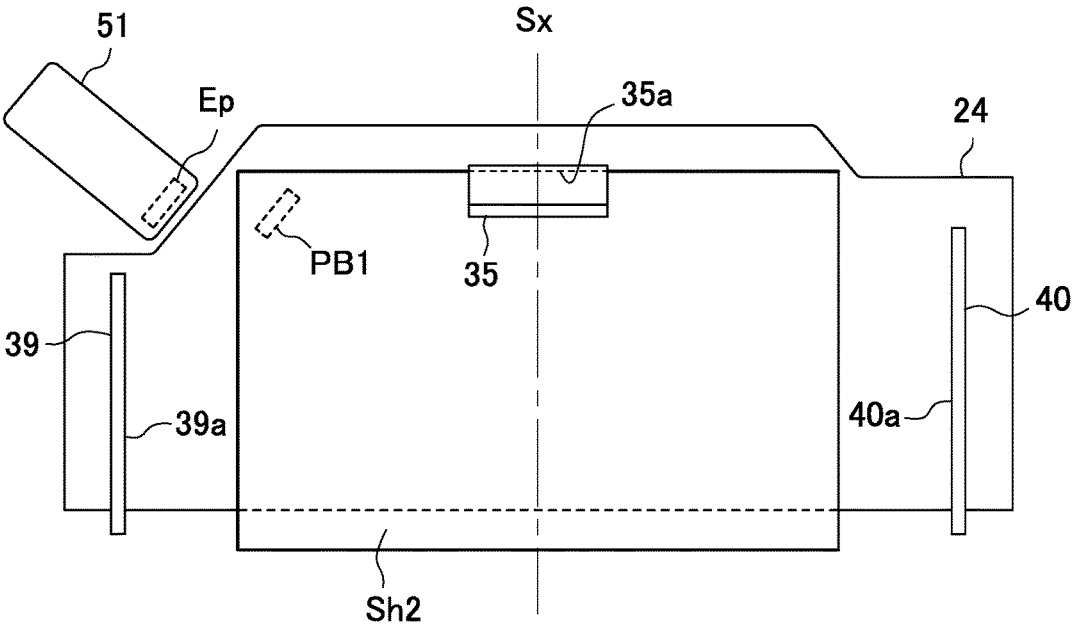

Then, the binding control section 61 detects an additional sheet Sh2 discharged onto the processing tray 24 from the discharge port 23 of the device housing 21 from signals output from the discharge sensors Se1 and Se2 and then activates the sheet carry-in mechanism 26 to feed the sheet Sh2 on the first sheet bundle Sb1 to the back of the processing tray 24. As illustrated in FIG. 13B, the additional sheet Sh2 is conveyed by rotation of the raking rotor 36 until the leading end thereof in the carry-in direction abuts against the regulation face 35*a* of the regulation member 35.

Figure 13C:
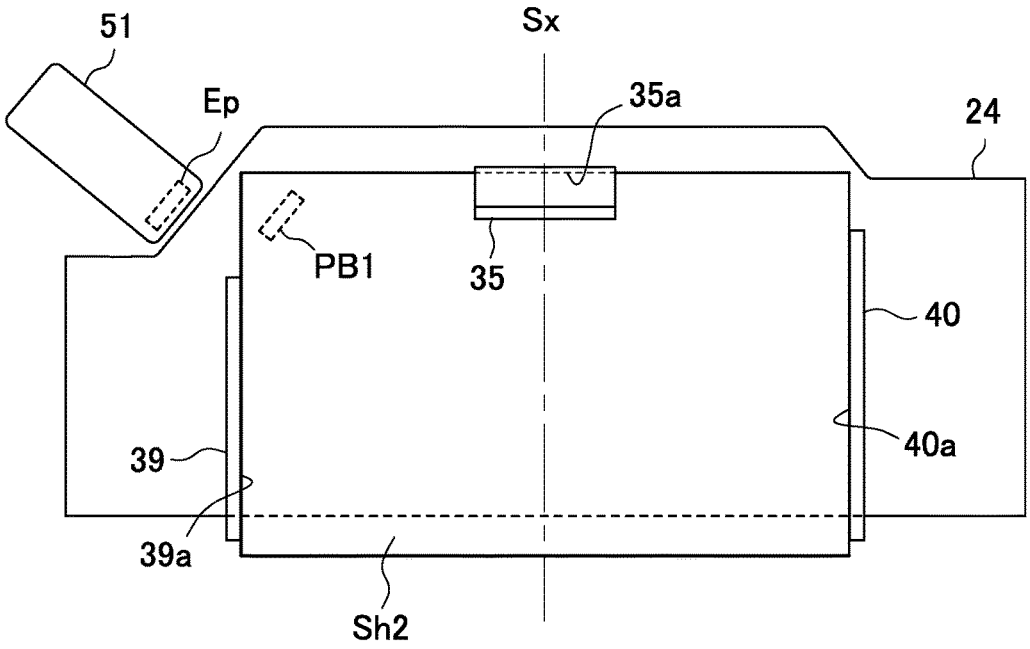
FIGS. 13C and 13D are explanatory views schematically illustrating a process of accumulating succeeding sheets on the sheet bundle that has been subjected to the first binding and performing second binding as viewed from above the sheet placing face of the processing tray.

After the conveyance of the additional sheet Sh2 is stopped by the regulation member 35, the binding control section 61 moves inward the left- and right-side aligning members 39 and 40 situated at the their respective retreated positions of FIG. 13B so as to sandwich the additional sheet Sh2 from both sides. The side aligning members 39 and 40 are moved until the regulation faces 39*a* and 40*a* thereof are engaged with the both side end edges of the additional sheet Sh2, that is, until the interval therebetween coincides with the width of the additional sheet Sh2. As a result, a plurality of additional sheets Sh2 are stacked on the first sheet bundle Sb1, and the resultant sheet bundle (second sheet bundle Sb2) is positioned while being aligned with the accumulating position where the center of the second sheet bundle Sb2 in the width direction coincides with the center reference line Sx of the processing tray 24, as illustrated in FIG. 13C. After that, the binding control section 61 returns the left- and right-side aligning members 39 and 40 to their respective retreated positions of FIG. 13B.

Figure 13D:
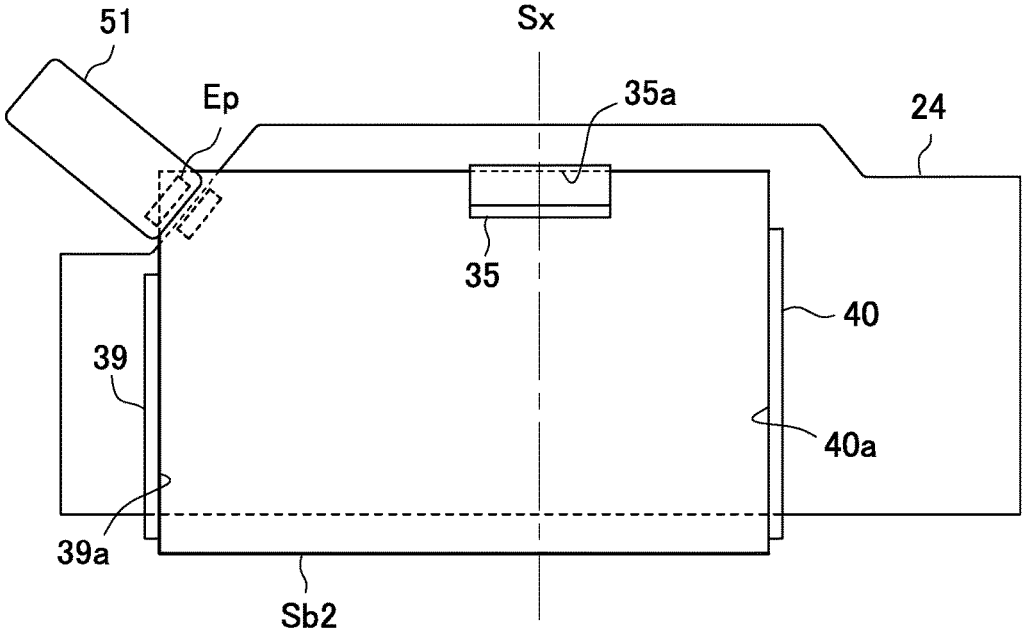

The above process illustrated in FIGS. 13A to 13C is repeated until a predetermined number of additional sheets Sh2 are accumulated on the processing tray 24 in the above-described aligned state. After the predetermines number of additional sheets Sh2 are aligned and accumulated on the first sheet bundle Sb1 stacked on the processing tray 24, the binding control section 61 does not return the left- and right-side aligning members 39 and 40 to their retreated positions, but, as illustrated in FIG. 13D, offset-moves the second sheet bundle Sb2 in the width direction toward the binding position Ep while holding the sheet bundle Sb2 with the aligning members 39 and 40 from both sides.

The left- and right-side aligning members 39 and 40 are stopped so that the side end edge of the second sheet bundle Sb2 on the device rear side is slightly inward from the stop position of FIG. 12E in the first binding. More specifically, the second sheet bundle Sb2 is disposed at a second binding position where the range of the mutually meshing crimping teeth parts of the staple-free binding unit 51, i.e., a part of the binding position Ep is displaced outward from the corner Sc of the second sheet bundle Sb2.

At the second binding position, the binding control section 61 issues a command signal that causes the staple-free binding unit 51 to execute second staple-free binding. In response to the command signal, the staple-free binding unit 51 presses and deforms the corner Sc of the second sheet bundle Sb2 into the wave-plate shape in cross section in a partial range of the mutually meshing upper crimping toothed part 55 and lower crimping toothed part 54 to thereby bind the second sheet bundle Sb2.

Figure 14B:
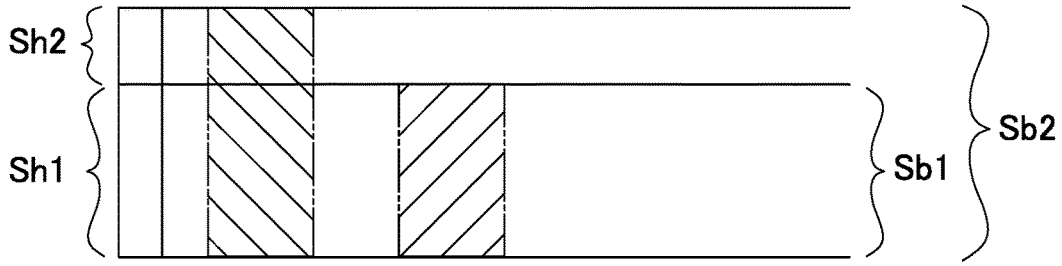
FIG. 14B is a cross-sectional view taken along a line XIV-XIV in FIG. 10A.

FIGS. 14A and 14B illustrate, in a partially enlarged manner, binding states of the first binding part PB1 of the first sheet bundle Sb1 that has been subjected to the proper binding through the first binding of the second pattern and the second binding part PB2 of the second sheet bundle Sb2 obtained by applying the temporary binding to the additional sheets Sh2 through the second binding. As described above, at the first binding part PB1, the sheets are pressed and bound over the entire range of the upper crimping toothed part 55 and lower crimping toothed part 54, so that a predetermined binding force specified in the staple-free binding unit 51 is exhibited.

As described above, at the second binding part PB2, the sheets are pressed and bound in a partial range of the upper crimping toothed part 55 and lower crimping toothed part 54, and the number of sheets of the second sheet bundle Sb2 is larger than that of the first sheet bundle Sb1 by the number of the additional sheets Sh2. Further, the second binding part PB2 is formed such that the upper crimping toothed part 55 and lower crimping toothed part 54 cross the side edge of the second sheet bundle Sb2. Thus, the binding force at the second binding part PB2 is smaller than that at the first binding part PB even when the press-binding is performed under the same pressure as in the first binding, so that the additional sheets can be removed from the second sheet bundle Sb2 more easily than the sheets Sh1 of the first sheet bundle Sb1.

As in the description of the first pattern, the binding force at the second binding part PB2 can be adjusted by the binding control section 61; hence, detailed description thereof will be omitted.

After the second binding illustrated in FIG. 13D, the staple-free binding unit 51 separates the upper crimping toothed part 55 and the lower crimping toothed part 54 from each other and issues a binding end signal to the binding control section 61. Thereafter, the binding control section drives the conveyer unit 45 and the conveying roller unit 46 to carry out the second sheet bundle Sb2 onto the stack tray 25. This process is the same as the process of the first pattern described with reference to FIGS. 11A and 11B; hence, further description will be omitted.

While the present invention has been described in connection with preferred embodiments, it is not limited thereto. It will be apparent that various modifications and changes can be made thereto within the technical scope of the invention. For example, although the staple-free binding unit is fixed to a predetermined position with respect to the processing tray in the above-described embodiment, it may be movably provided with respect to the processing tray. Further, the binding positions of the first and/or second sheet bundles with respect to the processing tray and the positions of the staple binding unit and the staple-free binding unit with respect to the processing tray may be set to different positions from those described in the above embodiment.

What is claimed is:

1. A sheet bundle binding device comprising:

a processing tray that receives a plurality of sheets;

a sheet accumulating mechanism that accumulates the plurality of sheets on the processing tray;

a staple binding unit that binds the plurality of sheets on the processing tray into a sheet bundle using a staple needle;

a staple-free binding unit having a pair of crimping toothed parts for staple-free binding the plurality of sheets on the processing tray into a sheet bundle; and a control section that performs drive control of the sheet accumulating mechanism, staple binding unit, and staple-free binding unit, wherein the staple binding unit and the staple-free binding unit can apply first binding processing to a first sheet bundle accumulated on the processing tray by the sheet accumulating mechanism, the sheet accumulating mechanism can accumulate additional sheets on the first sheet bundle that has been subjected to the first binding processing to form a second sheet bundle, the staple-free binding unit can apply second binding processing to the second sheet bundle, and the control section determines which one of the staple binding unit and staple-free binding unit is used to apply the first binding processing to the first sheet bundle.

2. The sheet bundle binding device according to claim 1, wherein the control section can determine not to apply the first binding processing to the first sheet bundle.

3. The sheet bundle binding device according to claim 1, wherein the control section can determine whether or not to apply the second binding processing to the second sheet bundle using the staple-free binding unit.

4. The sheet bundle binding device according to claim 1, wherein the control section determines which one of the staple binding unit and the staple-free binding unit is used to perform the first binding processing or not to perform the first binding processing according to the magnitude of a binding force by the first binding processing.

5. The sheet bundle binding device according to claim 2, wherein the control section determines which one of the staple binding unit and the staple-free binding unit is used to perform the first binding processing or not to perform the first binding processing according to the magnitude of a binding force with which the first sheet bundle is bound by the first binding processing.

6. The sheet bundle binding device according to claim 3, wherein the control section determines whether or not to perform the second binding processing according to the magnitude of a binding force with which the second sheet bundle is bound by the second binding processing.

7. The sheet bundle binding device according to claim 1, wherein the control section can move the staple binding unit and/or the staple-free binding unit relative to the first sheet bundle on the processing tray to which the first binding processing is applied and/or can move the staple-free binding unit relative to the second sheet bundle on the processing tray to which the second binding processing is applied.

8. The sheet bundle binding device according to claim 1, wherein the staple binding unit can be moved in a direction perpendicular to a predetermined carry-out direction in which the first sheet bundle or the second sheet bundle is carried out from the processing tray along the side of the first sheet bundle on the opposite side to the predetermined carry-out direction.

9. The sheet bundle binding device according to claim 1, wherein the control section drive-controls the sheet accumulating mechanism so as to move the first sheet bundle and/or the second sheet bundle on the processing tray in a direction perpendicular to a predetermined carry-out direction in which the first sheet bundle or the second sheet bundle is carried out from the processing tray.

10. The sheet bundle binding device according to claim 1, further comprising a sheet bundle carry-out mechanism that carries out the first sheet bundle or the second sheet bundle from the processing tray in a predetermined carry-out direction, wherein the staple-free binding unit is disposed downstream of the staple binding unit in the predetermined carry-out direction, and the control section drive-controls the sheet bundle carry-out mechanism so as to move the first sheet bundle that has been subjected to the first binding processing or the second sheet bundle obtained by accumulating the additional sheets on the first sheet bundle from the staple binding unit side to the staple-free binding unit side for the second binding processing.

11. The sheet bundle binding device according to claim 10, wherein the control section drive-controls the sheet bundle carry-out mechanism so as to change the position of the second sheet bundle relative to the staple-free binding unit in order to adjust the magnitude of a binding force with which the second sheet bundle is bound through the second binding processing.

12. The sheet bundle binding device according to claim 1 further comprising a sheet bundle aligning mechanism which is drive-controlled by the control section so as to align the plurality of sheets accumulated on the processing tray into a sheet bundle.

13. An image forming system comprising:

an image forming unit that forms an image onto a sheet; and a sheet bundle binding unit that accumulates a plurality of sheets conveyed from the image forming unit and binds the plurality of sheets, the sheet bundle binding unit being the sheet bundle binding device as claimed in claim 1.

* * * * *